US007841194B2

(12) United States Patent
Ishida et al.

(10) Patent No.: US 7,841,194 B2
(45) Date of Patent: Nov. 30, 2010

(54) AIR CONDITIONER AND METHOD OF CONTROLLING SUCH

(75) Inventors: Satoshi Ishida, Sakai (JP); Nobuki Matsui, Sakai (JP); Tomohiro Yabu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1107 days.

(21) Appl. No.: 10/593,474

(22) PCT Filed: Mar. 24, 2005

(86) PCT No.: PCT/JP2005/005345

§ 371 (c)(1),
(2), (4) Date: Sep. 19, 2006

(87) PCT Pub. No.: WO2005/098325

PCT Pub. Date: Oct. 20, 2005

(65) Prior Publication Data

US 2007/0144189 A1 Jun. 28, 2007

(30) Foreign Application Priority Data

Mar. 31, 2004 (JP) ..... 2004-104763

(51) Int. Cl.
*F25B 49/00* (2006.01)
*G05D 22/00* (2006.01)

(52) U.S. Cl. ..... 62/176.6; 236/44 C

(58) Field of Classification Search ..... 62/157, 62/176.1, 176.6, 232; 236/44 A, 44 C
See application file for complete search history.

(56) References Cited

U.S. PATENT DOCUMENTS

| | | | | |
|---|---|---|---|---|
| 4,744,223 A | 5/1988 | Umezu | | |
| 6,205,797 B1 * | 3/2001 | Maeda | | 62/94 |
| 7,395,677 B2 * | 7/2008 | Fujiyoshi et al. | | 62/324.1 |
| 2006/0026976 A1 * | 2/2006 | Carpenter | | 62/176.1 |
| 2007/0180851 A1 * | 8/2007 | Fujiyoshi et al. | | 62/480 |
| 2007/0193287 A1 * | 8/2007 | Ishida et al. | | 62/176.1 |

FOREIGN PATENT DOCUMENTS

| | | | |
|---|---|---|---|
| EP | 1 450 113 A1 | | 8/2004 |
| JP | 60108635 A | * | 6/1985 |
| JP | 62-129639 A | | 6/1987 |
| JP | 06-101894 A | | 4/1994 |
| JP | 08-178399 A | | 7/1996 |
| JP | 10318617 A | * | 12/1998 |
| JP | 2002-323251 A | | 11/2002 |
| JP | 2003-161465 A | | 6/2003 |
| JP | 2004-069257 A | | 3/2004 |
| JP | 2004-353887 A | | 12/2004 |
| WO | WO-03-046441 A1 | | 6/2003 |

* cited by examiner

*Primary Examiner*—Marc E Norman
(74) *Attorney, Agent, or Firm*—Global IP Counselors

(57) ABSTRACT

The invention provides an air conditioner that is capable of performing optimal control in accordance with the environment of an indoor space at startup, and a method of controlling such. The air conditioner forms a refrigerant circuit having a first heat exchanger, a second heat exchanger, thermistors, humidity sensors, a temperature sensor, ventilation fans, a compressor, a casing, a control unit, and the like. The control unit is connected to the temperature sensor, the humidity sensors, a storage unit, a timer, a manual input unit, air passageway switching mechanisms, a four-way switching valve, and an expansion valve. In the stage before the air conditioner starts normal operation after startup, the control unit performs a priority control operation that prioritizes either the sensible heat process or the latent heat process.

12 Claims, 15 Drawing Sheets

AIR CONDITIONER AND METHOD OF CONTROLLING SUCH

CROSS-REFERENCE TO RELATED APPLICATIONS

This U.S. National stage application claims priority under 35 U.S.C. §119(a) to Japanese Patent Application No. 2004-104763, filed in Japan on Mar. 31, 2004, the entire contents of which are hereby incorporated herein by reference.

FIELD OF THE INVENTION

The present invention relates to an air conditioner that comprises a function that performs a sensible heat process and a function that performs a latent heat process, and to a method of controlling such.

RELATED ART

To maintain a comfortable environment in an indoor space, an air conditioner is conventionally offered that comprises functions to process the sensible heat load and the latent heat load, respectively, that are present in the indoor space.

In particular, the air conditioner disclosed in Japanese Published Unexamined Patent Application No. 2004-69257 separately provides a sensible heat processing unit that performs a sensible heat process and a latent heat processing unit that performs a latent heat process. Furthermore, control is performed to efficiently maintain a comfortable environment in the indoor space by, for example, measuring the temperature and the humidity in the indoor space during normal operation of the air conditioner and modifying the balance between the sensible heat process and the latent heat process.

SUMMARY OF THE INVENTION

Nevertheless, the conventional air conditioner disclosed in the above publication has the following types of problems.

Namely, although the air conditioner disclosed in the abovementioned publication performs control while taking into consideration the balance between the sensible heat process and the latent heat process during normal operation, it does not particularly consider operational control at startup. Consequently, if, for example, the latent heat load in the indoor space is large at startup, then one can hardly say that efficient operational control is performed immediately after startup.

It is an object of the present invention to provide an air conditioner that is capable of performing optimal control in accordance with the environment in the indoor space at startup, and a method of controlling such.

An air conditioner according to a first aspect of the present invention processes the sensible heat load and the latent heat load in an indoor space by performing a vapor compression type refrigeration cycle operation, and comprises a control unit. The control unit that performs priority control operation that prioritizes processing at least one of the sensible heat load or the latent heat load from startup until normal operation is started.

In this aspect of the invention, the control unit performs control so as to prioritize either the sensible heat process or the latent heat process at startup. Thereby, it is possible to perform operation that prioritizes the appropriate process in accordance with the indoor environment at startup, such as, for example, by performing control that prioritizes the latent heat process if the humidity in the indoor space is high at startup. Accordingly, by performing priority control operation so as to optimize operation characteristics in accordance with the environment in the indoor space at startup, it is possible to provide a comfortable environment to the user immediately upon startup more efficiently than with normal operation.

In addition, the control unit performs control that switches to normal operation if, for example, priority control operation at startup ends based on the timer. Thereby, it is possible to switch smoothly to normal operation after performing optimal priority control operation in accordance with the state of the indoor space at startup.

An air conditioner according to a second aspect of the present invention is the air conditioner according to the first aspect of the present invention, further comprising a detector unit, which detects at least one of the temperature or the humidity in the indoor space.

This aspect of the invention comprises a detection unit that detects the temperature and the humidity in the indoor space. Consequently, the control unit can determine, based on the detection result of the detection unit, whether to start priority control operation that prioritizes either the sensible heat process or the latent heat process.

An air conditioner according to a third aspect of the present invention is the air conditioner according to the second aspect of the present invention, wherein the control unit switches from priority control operation to normal operation if the detector unit detects that at least one of the temperature or the humidity in the indoor space has reached a preset temperature or humidity.

In this aspect of the invention, priority operation is continued until the temperature and/or the humidity in the indoor space reaches the desired temperature and/or humidity set, for example, by the user. Thereby, even if the sensible heat load or the latent heat load is extremely large at startup, it is possible to continue priority control operation until the humidity in the indoor space reaches the prescribed value, and then to switch to normal operation after the prescribed value is reached.

An air conditioner according to a fourth aspect of the present invention is the air conditioner according to any one aspect of the first through third aspects of the present invention, further comprising a timer unit, wherein the time limit for performing priority control operation is set; wherein, the control unit switches from priority control operation to normal operation based on the time set in the timer unit.

In this aspect of the invention, the switching from priority control operation to normal operation is controlled by the time set in the timer unit (timer). Consequently, it is possible to switch to normal operation after performing priority control operation for the prescribed time.

An air conditioner according to a fifth aspect of the present invention is the air conditioner according to any one aspect of the first through fourth aspects of the present invention, wherein the control unit switches from priority control operation to normal operation if there is a manual input from the user.

In this aspect of the invention, if a manual input is received from the user during priority control operation at startup, then priority control operation is switched to normal operation, regardless of the extent to which the timer setting or the set temperature and humidity has been reached. Consequently, it is possible to switch from priority control operation to normal operation at the user's desired timing.

An air conditioner according to a sixth aspect of the present invention is the air conditioner according to the second aspect of the present invention, wherein even during priority control operation, the control unit switches, based on the detection result from the detector unit, from priority control operation that prioritizes processing the sensible heat load to priority control operation that prioritizes processing the latent heat load, or from priority control operation that prioritizes processing the latent heat load to priority control operation that prioritizes processing the sensible heat load.

In this aspect of the invention, if the detection unit detects an increase in the sensible heat load in the indoor space during priority control operation that prioritizes the latent heat process, for example, operation is switched to priority control operation that prioritizes the sensible heat process, even during priority control operation that prioritizes the latent heat process. Thereby, it is possible to flexibly perform priority control operation in accordance with, for example, changes in the indoor environment, even during priority control operation.

An air conditioner according to a seventh aspect of the present invention is the air conditioner according to any one aspect of the first through sixth aspects of the present invention, wherein the control unit determines, based on an initial setting, whether to perform priority control operation that prioritizes processing the sensible heat load or to processing the latent heat load at startup.

In this aspect of the invention, the process that is prioritized during operation at startup is determined by initial settings, and it is consequently possible to set initial settings so that the process appropriate to the season is prioritized. Thereby, it is possible to perform optimal control in accordance with changes, for example, in the environment, and the environment in the indoor space can therefore be made comfortable promptly.

An air conditioner according to an eighth aspect of the present invention is the air conditioner according to any one aspect of the first through seventh aspects of the present invention, further comprising: an adsorbent that adsorbs moisture in the air, and a heat exchanger, wherein the refrigerant that flows in a refrigerant circuit, which constitutes the refrigeration cycle, is supplied; wherein, the control unit performs operation while alternating the heat exchanger, every time a prescribed batch switching time elapses, between regeneration operation, wherein the heat exchanger is made to function as a condenser and desorbs the moisture from the adsorbent, and an adsorption operation, wherein the heat exchanger is made to function as an evaporator and adsorbs the moisture in the air onto the adsorbent.

In this aspect of the invention, the control unit performs operation while alternating, every time a prescribed batch switching time elapses, between regeneration operation, wherein the heat exchanger is made to function as a condenser, and adsorption operation, wherein the heat exchanger is made to function as an evaporator. Thereby, it is possible to perform so-called batch control, wherein the sensible heat load and the latent heat load are processed using a heat exchanger.

An air conditioner according to a ninth aspect of the present invention is the air conditioner according to the eighth aspect of the present invention, wherein if processing the sensible heat load is prioritized in priority control operation, then the control unit performs at least one of the following: control that sets the batch switching time so that it is longer than during normal operation, or control that sets a condensing temperature target value of the refrigerant in the refrigeration cycle so that it is higher than during normal operation.

In this aspect of the invention, if operation is performed that prioritizes the sensible heat process at startup, then control is performed by setting the batch switching time and/or the condensing temperature target value to an appropriate value. For example, if the batch switching time during cooling operation is set so that it is longer than during normal operation, then the heat exchanger on the side that functions as an evaporator is sufficiently cooled, the amount of moisture (amount of latent heat processed) adsorbed onto the adsorbent decreases with the passage of time, and the heat of adsorption at the surface of the heat exchanger decreases, and it is consequently possible to improve sensible heat processing capacity. Thereby, it is possible to perform operation that prioritizes the sensible heat process in accordance with the amount of sensible heat load contained in the indoor space at startup. In addition, by modifying one or both of the abovementioned settings, it is possible to divide the sensible heat processing capacity into a number of stages, which makes it possible to perform priority control operation flexibly.

An air conditioner according to a tenth aspect of the present invention is the air conditioner according to the eighth aspect of the present invention, wherein if processing the latent heat load is prioritized in priority control operation, then the control unit performs at least one of the following: control that sets the batch switching time so that it is shorter than during normal operation, or control that sets a condensing temperature target value of the refrigerant in the refrigeration cycle so that it is higher than during normal operation.

In this aspect of the invention, if operation is performed that prioritizes the latent heat process at startup, then control is performed by setting the batch switching time and/or the condensing temperature target value to an appropriate value. For example, if the batch switching time during cooling operation is set so that it is shorter than during normal operation, then operation is alternated between adsorption operation and regeneration operation for a short period of time, and it is consequently possible to continuously maintain the adsorption power of the adsorbent at a high level. Thereby, it is possible to perform operation that prioritizes processing the latent heat load contained in the indoor space at startup. In addition, by modifying one or both of the abovementioned settings, it is possible to perform priority control operation by flexibly switching the performance of the latent heat process in accordance with the amount of the latent heat load contained in the indoor space at startup.

An air conditioner according to an eleventh aspect of the present invention is the air conditioner according to the eighth aspect of the present invention, wherein a circulating operation is performed wherein the sensible heat load or the latent heat load of the air taken in from the indoor space is processed, the processed air is exhausted to the indoor space, the sensible heat load or the latent heat load is supplied to the air taken in from the outdoor space and then exhausted thereto.

In this aspect of the invention, operation is performed while circulating air in the indoor space. Consequently, the air conditioner can perform circulating, dehumidifying, and humidifying operation even in the case of, for example, a desiccant type humidity conditioner that does not have a ventilation function, or an outdoor air conditioner that performs operation in circulation mode that adjusts the passageways but does not perform ventilation.

An air conditioner according to a twelfth aspect of the present invention is the air conditioner according to the eleventh aspect of the present invention, wherein if processing the sensible heat load is prioritized in priority control operation, then the control unit performs at least one of the following: control that sets the batch switching time so that it is longer than during normal operation, control that sets a condensing temperature target value of the refrigerant in the refrigeration cycle so that it is higher than during normal operation, or control that increases the circulation of air taken in from the outdoor space.

In this aspect of the invention, if the control unit in, for example, a humidity conditioner that performs circulating operation selects a priority control operation that prioritizes the sensible heat process, then the control unit adjusts the settings of the batch switching time, the condensing temperature target value, and the circulation of air taken in from the outdoor space. Thereby, it is possible to perform priority control operation that improves the sensible heat processing capacity, even with, for example, a humidity conditioner that performs circulating operation.

An air conditioner according to a thirteenth aspect of the present invention is the air conditioner according to the eleventh aspect of the present invention, wherein if processing the latent heat load is prioritized in priority control operation, then the control unit performs at least one of the following: control that sets the batch switching time so that it is shorter than during normal operation, or control that sets a condensing temperature target value of the refrigerant in the refrigeration cycle so that it is higher than during normal operation.

In this aspect of the invention, if the control unit in, for example, a humidity conditioner that performs circulating operation selects priority control operation that prioritizes the latent heat process at startup, then the control unit adjusts the settings of the batch switching time and the condensing temperature target value. Thereby, even with, for example, a humidity conditioner that performs circulating operation, it is possible to perform priority control operation that improves the latent heat processing capacity.

A method of controlling an air conditioner according to a fourteenth aspect of the present invention is a method of controlling an air conditioner that processes the sensible heat load and the latent heat load in an indoor space by performing a vapor compression type refrigeration cycle operation. Further, the method performs priority control operation that prioritizes, from startup until normal operation begins, at least one of the following: processing the sensible heat load, or processing the latent heat load.

In this aspect of the invention, the control unit performs control so as to prioritize either the sensible heat process or the latent heat process at startup. Thereby, it is possible to perform operation that prioritizes the appropriate process in accordance with the environment in the indoor space at startup, such as, for example, by performing control that prioritizes the latent heat process if the humidity in the indoor space is high at startup. Accordingly, by performing priority control operation so as to optimize operation characteristics in accordance with the environment in the indoor space at startup, it is possible to provide a comfortable environment to the user more efficiently than with conventional operation, which continuously performs the sensible heat process and the latent heat process with a prescribed balance.

In addition, operation switches to normal operation if, for example, priority control operation at startup is terminated by, for example, the timer. Thereby, it is possible to smoothly switch to normal operation after performing optimal priority control operation in accordance with the state of the indoor space at startup.

DETAILED DESCRIPTION OF THE PREFERRED EMBODIMENTS

Figure 1:
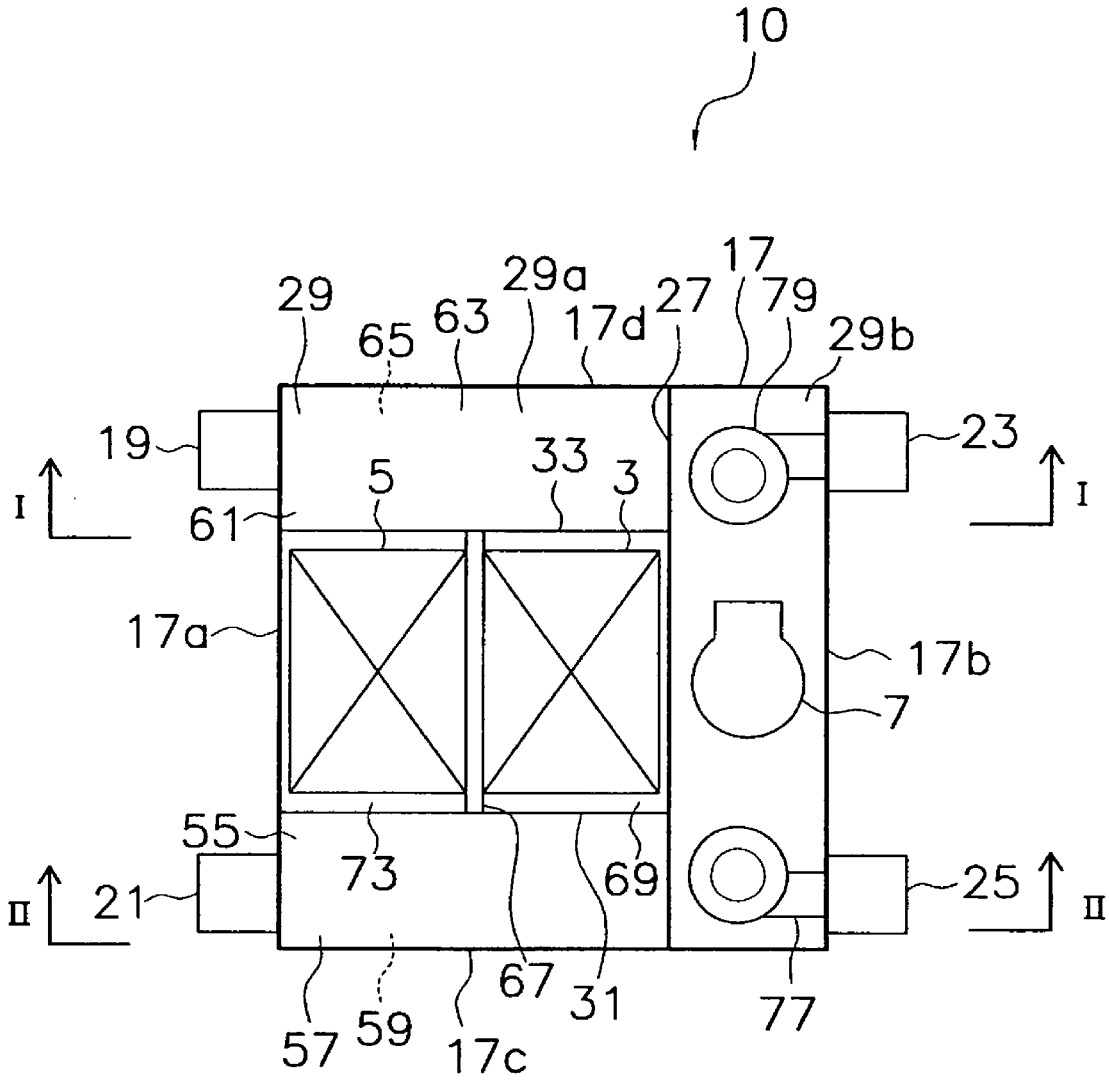
FIG. 1 is a plan view that shows the constitution of an air conditioner according to one embodiment of the present invention.

The following explains an air conditioner according to one embodiment of the present invention, and a method of controlling such, referencing FIG. 1-FIG. 13.

<Constitution of the Entire Air Conditioner>

An air conditioner 10 of the present embodiment is a desiccant-type outdoor air conditioner that supports an adsorbent, such as silica gel, on the surface of a heat exchanger, and that performs a cooling and dehumidifying operation or a heating and humidifying operation upon air that is supplied to an indoor space. In addition, the air conditioner 10 forms a refrigerant circuit 1, which is discussed later, and comprises a first heat exchanger (heat exchanger) 3, a second heat exchanger (heat exchanger) 5 (refer to FIG. 1-FIG. 3 and FIG. 5), thermistors 3*a*, 5*a*, humidity sensors (detector units) 3*b*, 5*b*, a temperature sensor (detector unit) 4 (refer to FIG. 5), ventilation fans 77, 79, a compressor 7, a casing 17, a control unit 80 (refer to FIG. 11), and the like.

Figure 4:
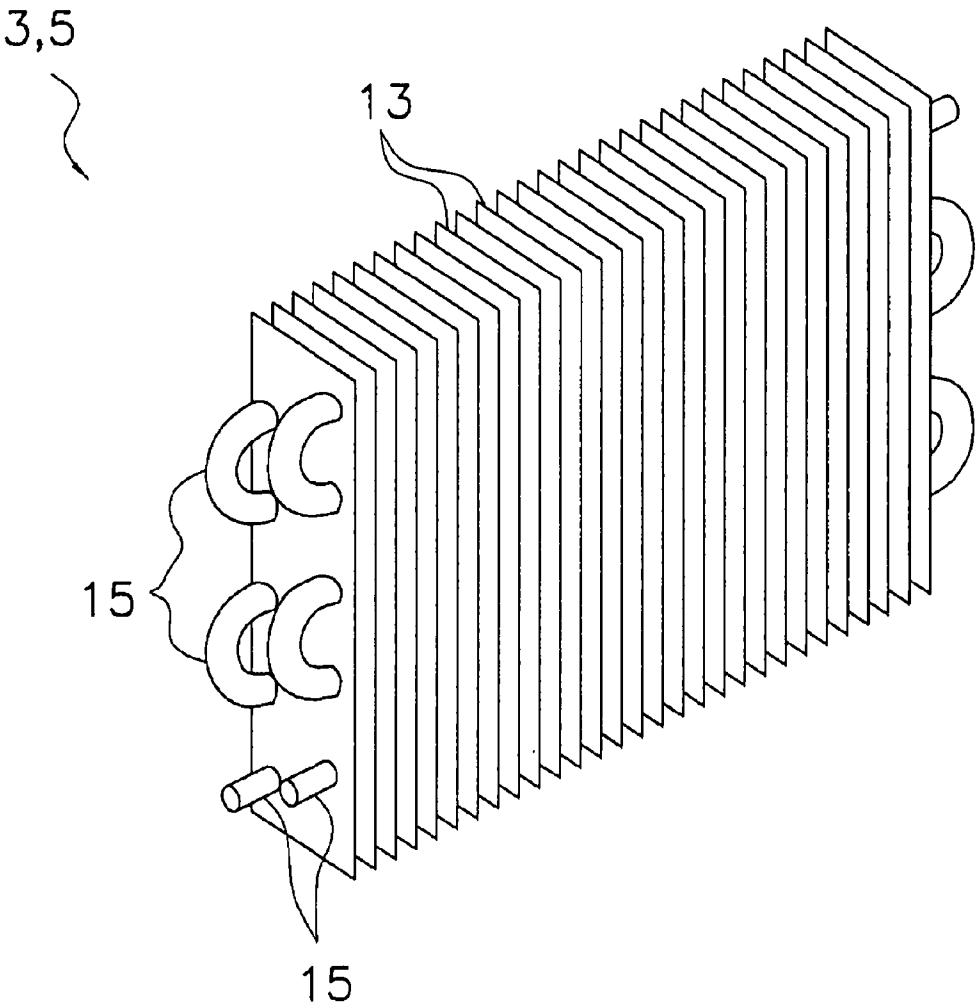
FIG. 4 is a perspective view that shows a heat exchanger that constitutes the air conditioner in FIG. 1.

The first heat exchanger 3 and the second heat exchanger 5 are cross fin-type fin and tube heat exchangers, as shown in FIG. 4, and each comprises numerous fins 13, each of which is made of aluminum and formed in a rectangular plate shape, as well as a heat transfer tube 15, which is made of copper and passes through the fins 13. The adsorbent, which adsorbs moisture contained in the air that passes through the first and second heat exchangers 3, 5, is supported on the external surface of each of the fins 13 and the heat transfer tube 15 by dip forming and the like.

Materials that can be used as the adsorbent include zeolite, silica gel, activated charcoal, a hydrophilic or water absorbent organic polymer material, an ion exchange resin material that has a carboxylic acid group or a sulfonic group, and a functional polymer material, such as a thermosensitive polymer.

Furthermore, the control unit 80, which is discussed later, performs so-called batch control by alternating the first and second heat exchangers 3, 5 between a first state, wherein the first heat exchanger 3 functions as a condenser and the second heat exchanger 5 functions as an evaporator, and a second state, wherein the first heat exchanger 3 functions as an evaporator and the second heat exchanger 5 functions as a condenser. In addition, in the first state, the first heat exchanger 3 functions as a condenser and performs an adsorbent regeneration operation that desorbs the moisture from the adsorbent, and the second heat exchanger 5 functions as an evaporator and performs an adsorption operation that adsorbs the moisture onto the adsorbent. On the other hand, in the second state, the first heat exchanger 3 functions as an evaporator and performs adsorption operation that adsorbs the moisture onto the adsorbent, and the second heat exchanger 5 functions as a condenser and performs the adsorbent regeneration operation that desorbs the moisture from the adsorbent. Thus, adsorption operation and regeneration operation in the first heat exchanger 3 and the second heat exchanger 5 are performed alternately, the passageway of the air that passes through the heat exchangers 3, 5 and is supplied to the indoor and outdoor spaces is switched, and it is thereby possible to continuously adsorb and release (desorb) the moisture onto and from the adsorbent. Thereby, it is possible to stably perform the various operations while maintaining dehumidification or humidification performance.

In addition, when the first heat exchanger 3 and the second heat exchanger 5 function as evaporators, they process the sensible heat load by exchanging the heat between the refrigerant, which flows through the heat exchangers 3, 5, and the air, which passes therethrough, and also perform a latent heat process, wherein the adsorbent, which is supported on the surfaces of the heat exchangers 3, 5, adsorbs the moisture contained in the air that passes through the heat exchangers 3, 5. Furthermore, by using the two heat exchangers 3, 5 to alternately perform adsorption operation and regeneration operation in the first state and the second state, it is possible to perform both the sensible heat process and the latent heat process in a stable state without reducing the adsorption power of the adsorbent.

The thermistor 3*a* is attached to the first heat exchanger 3 and measures the surface temperature (refrigerant temperature) thereof in the first state, wherein the first heat exchanger 3 functions as a condenser, and the second state, wherein the first heat exchanger 3 functions as an evaporator.

The humidity sensor 3*b* measures the humidity of the air before or after it passes through the first heat exchanger 3 in accordance with the switching of the passageway of the air in an air passageway switching mechanism 91.

The temperature sensor 4 measures the temperature in the indoor space.

The thermistor 5*a* is attached to the second heat exchanger 5 and measures the surface temperature (refrigerant temperature) thereof in the first state, wherein the second heat exchanger 5 functions as an evaporator, and the second state, wherein it functions as a condenser.

The humidity sensor 5*b* measures the humidity of the air before or after it passes through the second heat exchanger 5 in accordance with the switching of the passageway of the air in the air passageway switching mechanism 91.

The first fan 79 is attached so that it corresponds to the position of a first blow out port 23, and feeds the air from the inside to the outside of the casing 17.

The second fan 77 is attached so that it corresponds to the position of a second blow out port 25, and feeds air from the inside to the outside of the casing 17. Furthermore, the first and second fans 77, 79 form an air passageway in the air conditioner 10 through a first suction port 19, a second suction port 21, the first blow out port 23, and the second blow out port 25, which are discussed later.

The casing 17 is a substantially rectangular parallelepipedic box and houses the refrigerant circuit 1, which is discussed later. The first suction port 19, which takes in outdoor air OA, and the second suction port 21, which takes in indoor air RA (i.e., the return air), are formed in a left side surface plate 17*a* of the casing 17. Moreover, the first blow out port 23, which exhausts exhaust air EA to the outdoor space, and the second blow out port 25, which supplies air-conditioned air SA to the indoor space, are formed in a right side surface plate 17*b* of the casing 17. In addition, a partition plate 27, which functions as a partition member that partitions the interior of the casing 17, is provided inside the casing 17. Furthermore, the casing 17 comprises an air chamber 29*a* and an equipment chamber 29*b*, which are formed by the partition plate 27.

Figure 2:
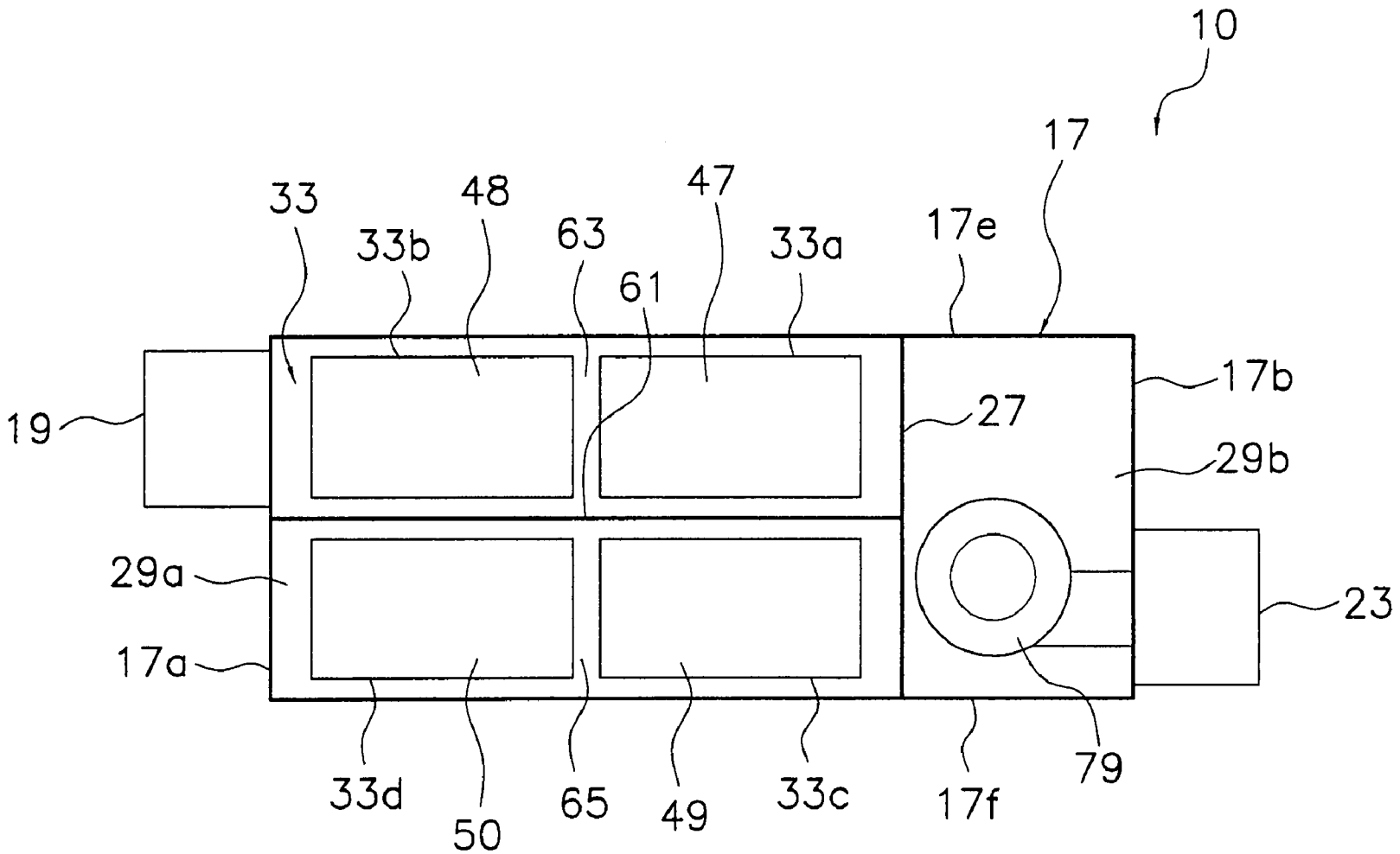
FIG. 2 is an auxiliary cross sectional view that shows the constitution of the interior of a casing, taken along the I-I line in FIG. 1.
Figure 3:
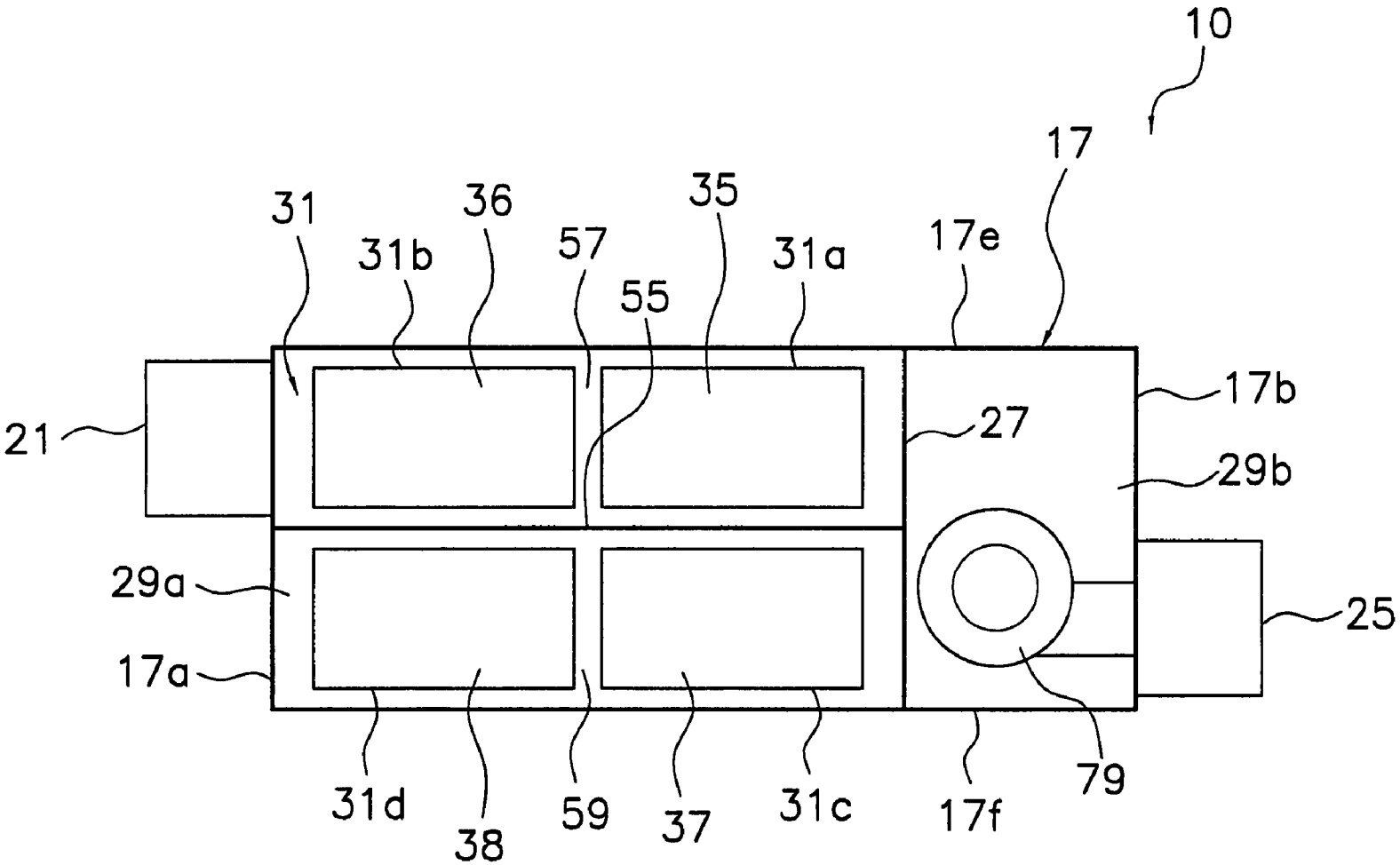
FIG. 3 is an auxiliary cross sectional view that shows the constitution of the interior of the casing, taken along the II-II line in FIG. 1.

The partition plate 27 is provided so that it extends from a front surface plate 17*c*, which is a front end of the casing 17, to a rear surface plate 17*d*, which is the rear end of the casing 17, and is disposed slightly to the right side of a center part of the casing 17, as shown in FIG. 1. Furthermore, the partition plate 27 is provided in the vertical direction, which is the thickness direction of the casing 17, and is provided so that it extends from an upper surface plate 17*e*, which is the upper end of the casing 17, to a lower surface plate 17*f*, which is the lower end of the casing 17, as shown in FIG. 2 and FIG. 3.

A center section plate 67 between a first end surface plate 33 and a second end surface plate 31 is provided to the air chamber 29*a* as a partition member. The first end surface plate 33 and the second end surface plate 31 are provided so that they extend from the left side surface plate 17*a* of the casing 17 to the partition plate 27, as shown in FIG. 1. In addition, the first end surface plate 33 is disposed slightly to the upper side of the center part of the casing 17, as shown in FIG. 1, and the second end surface plate 31 is disposed slightly to the lower side of the center part of the casing 17, as shown in FIG. 1. In addition, the first end surface plate 33 and the second end surface plate 31 are provided so that they extend from the upper surface plate 17*e* to the lower surface plate 17*f* of the casing 17, as shown in FIG. 2 and FIG. 3. The section plate 67 is provided so that it extends from the first end surface plate 33 to the second end surface plate 31, as shown in FIG. 1.

Among the members that constitute the refrigerant circuit 1 and excluding the heat exchangers 3, 5, the compressor 7 and the like are housed in the equipment chamber 29*b*, along with the first fan 79 and the second fan 77.

Furthermore, the air chamber 29*a* of the casing 17 comprises a first heat exchange chamber 69, which is formed by the first end surface plate 33, the second end surface plate 31, the section plate 67, and the partition plate 27, as well as a second heat exchange chamber 73, which is formed by the first end surface plate 33, the second end surface plate 31, the section plate 67, and the left side surface plate 17*a*.

The first heat exchanger 3 is disposed in the first heat exchange chamber 69, and the second heat exchanger 5 is disposed in the second heat exchange chamber 73.

A horizontal plate 61, which is a partition member, is provided between the first end surface plate 33 and the rear surface plate 17*d*, and forms a first inflow passageway 63 and a first outflow passageway 65. In addition, a horizontal plate 55, which is a partition member, is provided between the second end surface plate 31 and the front surface plate 17*c*, and forms a second inflow passageway 57 and a second outflow passageway 59.

The horizontal plates 61, 55 partition the internal space of the casing 17, wherein the first inflow passageway 63 is formed at the upper surface side and the first outflow passageway 65 is formed at the lower surface side, as shown in FIG. 2, and the second inflow passageway 57 is formed at the upper surface side and the second outflow passageway 59 is formed at the lower surface side, as shown in FIG. 3. In other words, the first inflow passageway 63 and the first outflow passageway 65 are formed along one end surface that is in the thickness direction of the first heat exchange chamber 69 and the second heat exchange chamber 73 where their surfaces are continuous; in addition, the first inflow passageway 63 and the first outflow passageway 65 are disposed overlaid in that thickness direction.

In addition, the second inflow passageway 57 and the second outflow passageway 59 are formed along an opposing surface, which opposes the abovementioned one end surface, that is an end surface of the first heat exchange chamber 69 and the second heat exchange chamber 73 where their surfaces are continuous, and are disposed overlaid in the thickness direction of the first heat exchange chamber 69 and the second heat exchange chamber 73.

Furthermore, the first inflow passageway 63 and the first outflow passageway 65 as well as the second inflow passageway 57 and the second outflow passageway 59 are disposed vertically symmetric, as shown in FIG. 1, i.e., they are disposed so that they are planar symmetric using the centerline that traverses the first heat exchange chamber 69 and the second heat exchange chamber 73 as a reference.

Furthermore, the first inflow passageway 63 communicates with the first suction port 19, and the first outflow passageway 65 communicates with the first blow out port 23 via the first fan 79. In addition, the second inflow passageway 57 communicates with the second suction port 21, and the second outflow passageway 59 communicates with the second blow out port 25 via the second fan 77.

Four openings 33*a*-33*d* are formed in the first end surface plate 33, as shown in FIG. 2. A first damper 47, a second damper 48, a third damper 49, and a fourth damper 50 are provided to the openings 33*a*-33*d*, respectively. The four openings 33*a*-33*d* are disposed proximately in the row and column directions, i.e., they are disposed in a matrix, with two at the top and the bottom, and two on the left and the right; furthermore, the first opening 33*a* and the third opening 33*c* are formed inside the first heat exchange chamber 69, and the second opening 33*b* and the fourth opening 33*d* are formed inside the second heat exchange chamber 73.

The first opening 33*a* brings the first inflow passageway 63 and the first heat exchange chamber 69 into communication, and the third opening 33*c* brings the first outflow passageway 65 and the first heat exchange chamber 69 into communication. In addition, the second opening 33*b* brings the first inflow passageway 63 and the second heat exchange chamber 73 into communication, and the fourth opening 33*d* brings the first outflow passageway 65 and the second heat exchange chamber 73 into communication.

Four openings 31*a*-31*d* are formed in the second end surface plate 31, as shown in FIG. 3. A fifth damper 35, a sixth damper 36, a seventh damper 37, and an eighth damper 38 are provided to the openings 31*a*-31*d*, respectively. The four openings 31*a*-31*d* are disposed proximately in the column and row directions. Namely, the four openings 31*a*-31*d* are disposed in a matrix with two on the top and the bottom, and two on the left and the right. Furthermore, the fifth opening 31*a* and the seventh opening 31*c* are formed inside the first heat exchange chamber 69, and the sixth opening 31*b* and the eighth opening 31*d* are formed inside the second heat exchange chamber 73.

The fifth opening 31*a* brings the second inflow passageway 57 and the first heat exchange chamber 69 into communication, and the seventh opening 31*c* brings the second outflow passageway 59 and the first heat exchange chamber 69 into communication. In addition, the sixth opening 31*b* brings the second inflow passageway 57 and the second heat exchange chamber 73 into communication, and the eighth opening 31*d* brings the second outflow passageway 59 and the second heat exchange chamber 73 into communication.

In addition, the first to eighth dampers 47-50, 35-38 comprise a switching means (air passageway switching mechanism 91; not shown) that opens and closes the openings 33*a*-33*d* and the openings 31*a*-31*d*, and this switching means is used to modify the passageway of the air when switching between the first state and the second state, which were discussed above.

Figure 11:
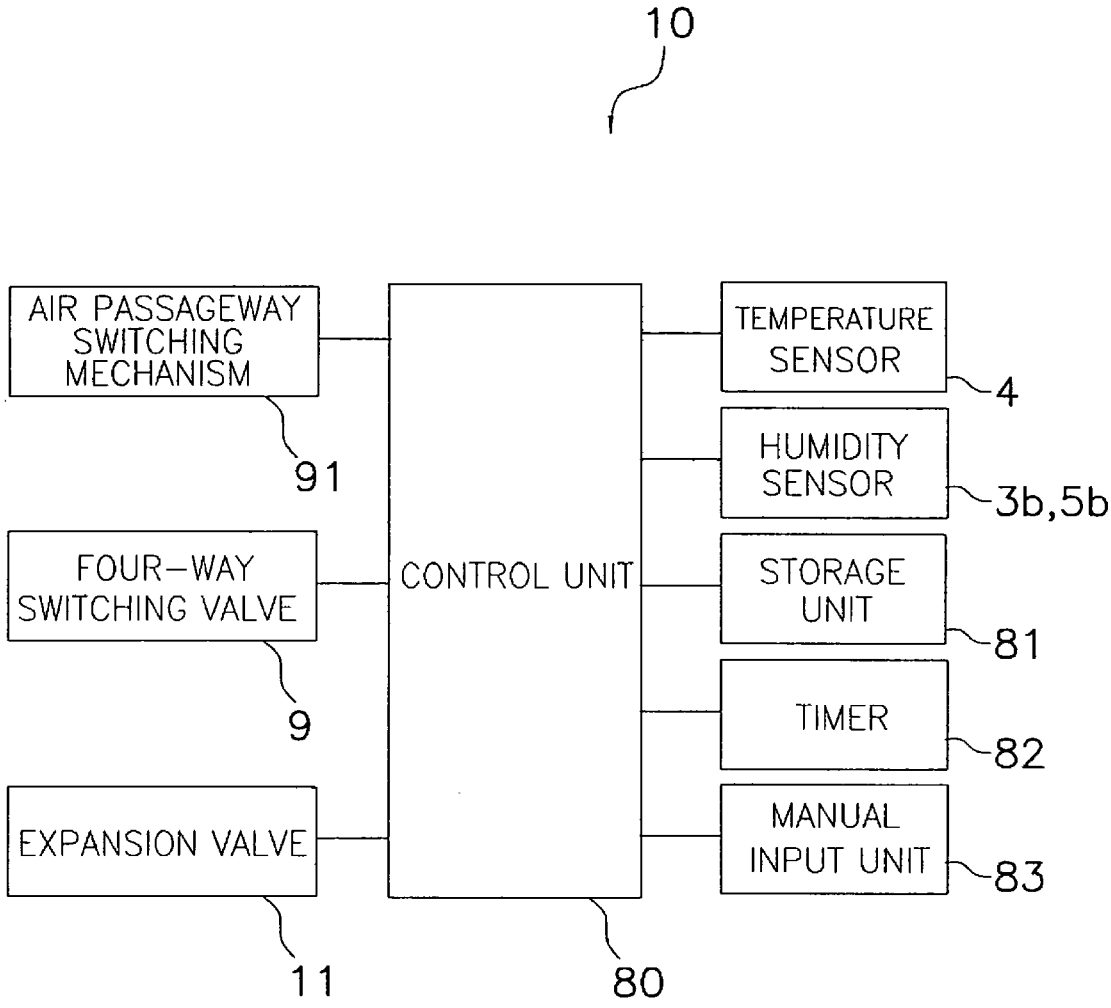
FIG. 11 is a block diagram that shows the constituent components that are connected to a control unit that constitutes the air conditioner in FIG. 1.

The air conditioner 10 of the present embodiment comprises the control unit 80, which is shown in FIG. 11, that performs control that is capable of alternating the air conditioner 10 between dehumidifying operation and humidifying operation. In addition, the control unit 80 is connected to the humidity sensors 3*b*, 5*b*, the temperature sensor 4, a storage unit 81, a timer (timer unit) 82, a manual input unit 83, the air passageway switching mechanism 91, a four-way switching valve 9, and an expansion valve 11, as shown in FIG. 11.

The humidity sensors 3*b*, 5*b* and the temperature sensor 4 are constituted as discussed above.

The storage unit 81 stores set values that constitute the targets for temperature and humidity control, the values of the initial settings for operational control, an operational control program of the air conditioner 10, and the like, and the air conditioner 10 is controlled during priority control operation based on the values stored in the storage unit 81.

The timer 82 functions as an on-off timer during normal operation and as a timer unit, which limits the continuation of priority control operation.

The manual input unit 83 receives input from the user at startup, when switching to normal operation, when switching to priority operation, and the like.

The air passageway switching mechanism 91 is a switching means (not shown), which comprises the first to eighth dampers 47-50, 35-38, and switches the air passageway based on an instruction from the control unit 80.

The four-way switching valve 9 switches the passageway of the refrigerant in the refrigerant circuit 1, which is discussed later. Furthermore, the four-way switching valve 9 is discussed in a later stage, where the refrigerant circuit 1 is explained.

The expansion valve 11 adjusts the pressure of the refrigerant in the refrigerant circuit 1, which is discussed later.

In addition, when the air conditioner 10 is performing dehumidifying operation, the control unit 80 makes the first heat exchanger 3 and the second heat exchanger 5 alternately function as an evaporator, and the moisture contained in the air that flows inside the air conditioner 10 via the first heat exchanger 3 or the second heat exchanger 5 is adsorbed onto the adsorbent. Meanwhile, the second heat exchanger 5 or the first heat exchanger 3 is made to function as a condenser, and the heat of condensation releases the moisture that was adsorbed onto the adsorbent into the air that flows inside the air conditioner 10 via the second heat exchanger 5 or the first heat exchanger 3, thereby regenerating the adsorbent. Furthermore, the circulation of the refrigerant in the refrigerant circuit 1 is switched, and the air passageway is switched by the first to eighth dampers 47-50, 35-38 so that the air that was dehumidified by the adsorbent is supplied to the indoor space and the air to which the moisture from the adsorbent was released is supplied to the outdoor space.

On the other hand, when the control unit 80 is performing humidifying operation, then the moisture contained in the air that flows inside the air conditioner 10 is adsorbed onto the adsorbent due to the endothermic action of the first heat exchanger 3 or the second heat exchanger 5 that is functioning as an evaporator. Meanwhile, the moisture that was adsorbed onto the adsorbent is released to the air that flows inside the air conditioner 10 due to the exothermic action of the second heat exchanger 5 or the first heat exchanger 3 that is functioning as a condenser, thereby regenerating the adsorbent. Furthermore, the circulation of the refrigerant in the refrigerant circuit 1 is switched, and the air distribution is switched by the dampers 47-50, 35-38 so that the air that was humidified by the releasing of the moisture from the adsorbent is supplied to the indoor space.

Specifically, when the control unit 80 performs dehumidifying operation in full ventilation mode, the outdoor air is changed to dehumidified air and supplied to the indoor space by taking in the outdoor air and adsorbing the moisture of the outdoor air onto the adsorbent, which is supported on the surface of the first heat exchanger 3 or the second heat exchanger 5 that is functioning as an evaporator. Meanwhile, the adsorbent is regenerated by taking in the indoor air and releasing the moisture from the adsorbent supported on the surface of the second heat exchanger 5 or the first heat exchanger 3 that is functioning as a condenser, and then releasing the humidified air to the outdoor space.

In addition, if the control unit 80 performs dehumidifying operation in circulation mode, then the indoor air is taken in, the moisture therein is adsorbed onto the adsorbent, which is supported on the surface of the first heat exchanger 3 or the second heat exchanger 5 that is functioning as an evaporator, and the dehumidified air is supplied to the indoor space. Meanwhile, dehumidifying operation is performed by taking in the outdoor air, regenerating the adsorbent by releasing the moisture from the adsorbent, which is supported on the surface of the second heat exchanger 5 or the first heat exchanger 3 that is functioning as a condenser, and then releasing the humidified air to the outdoor space.

However, if the control unit 80 performs humidifying operation in full ventilation mode, then the indoor air is taken in, the moisture contained in the air that was taken in is adsorbed onto the adsorbent, which is supported on the first heat exchanger 3 or the second heat exchanger 5 that is functioning as an evaporator, and the dehumidified air is exhausted to the outdoor space. Meanwhile, the outdoor air is taken in, the adsorbent is regenerated by releasing the moisture from the adsorbent, which is supported on the surface of the second heat exchanger 5 or the first heat exchanger 3 that is functioning as a condenser, and the humidified air is supplied to the indoor space.

In addition, if the control unit 80 performs humidifying operation in circulation mode, then the outdoor air is taken in, the moisture contained in the air that was taken in is adsorbed onto the adsorbent, which is supported on the surface of the first heat exchanger 3 or the second heat exchanger 5 that is functioning as an evaporator, and the dehumidified air is released to the outdoor space. Meanwhile, the indoor air is taken in, the adsorbent is regenerated by releasing the moisture from the adsorbent, which is supported on the surface of the second heat exchanger 5 or the first heat exchanger 3 that is functioning as a condenser, and the humidified air is released to the indoor space.

(Constitution of the Refrigerant Circuit)

Figure 5:
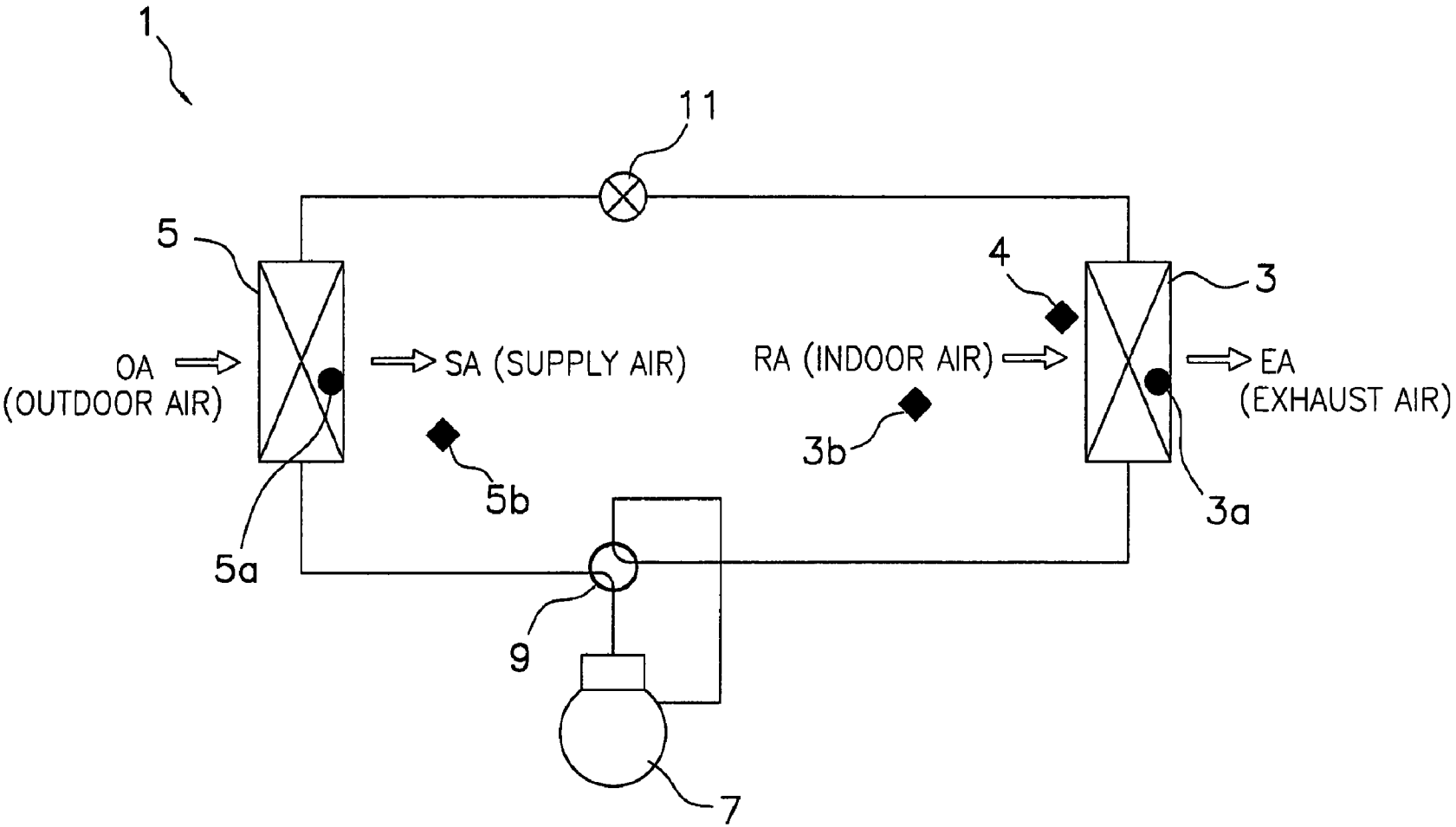
FIG. 5 is a circuit diagram that depicts a refrigerant circuit that constitutes the air conditioner in FIG. 1.

The refrigerant circuit 1 is formed as a closed circuit, wherein the compressor 7, the four-way switching valve 9, the first heat exchanger 3, the expansion valve 11, and the second heat exchanger 5 are connected in that order via a refrigerant piping, as shown in FIG. 5. Furthermore, the refrigerant circuit 1 is filled with a refrigerant, which circulates around the refrigerant circuit 1 and forms a vapor compression type refrigeration cycle.

One end of the first heat exchanger 3 is connected to the four-way switching valve 9, and another end is connected to one end of the second heat exchanger 5 via the expansion valve 11.

One end of the second heat exchanger 5 is connected to the first heat exchanger 3 via the expansion valve 11, and another end is connected to the four-way switching valve 9.

Figure 6:
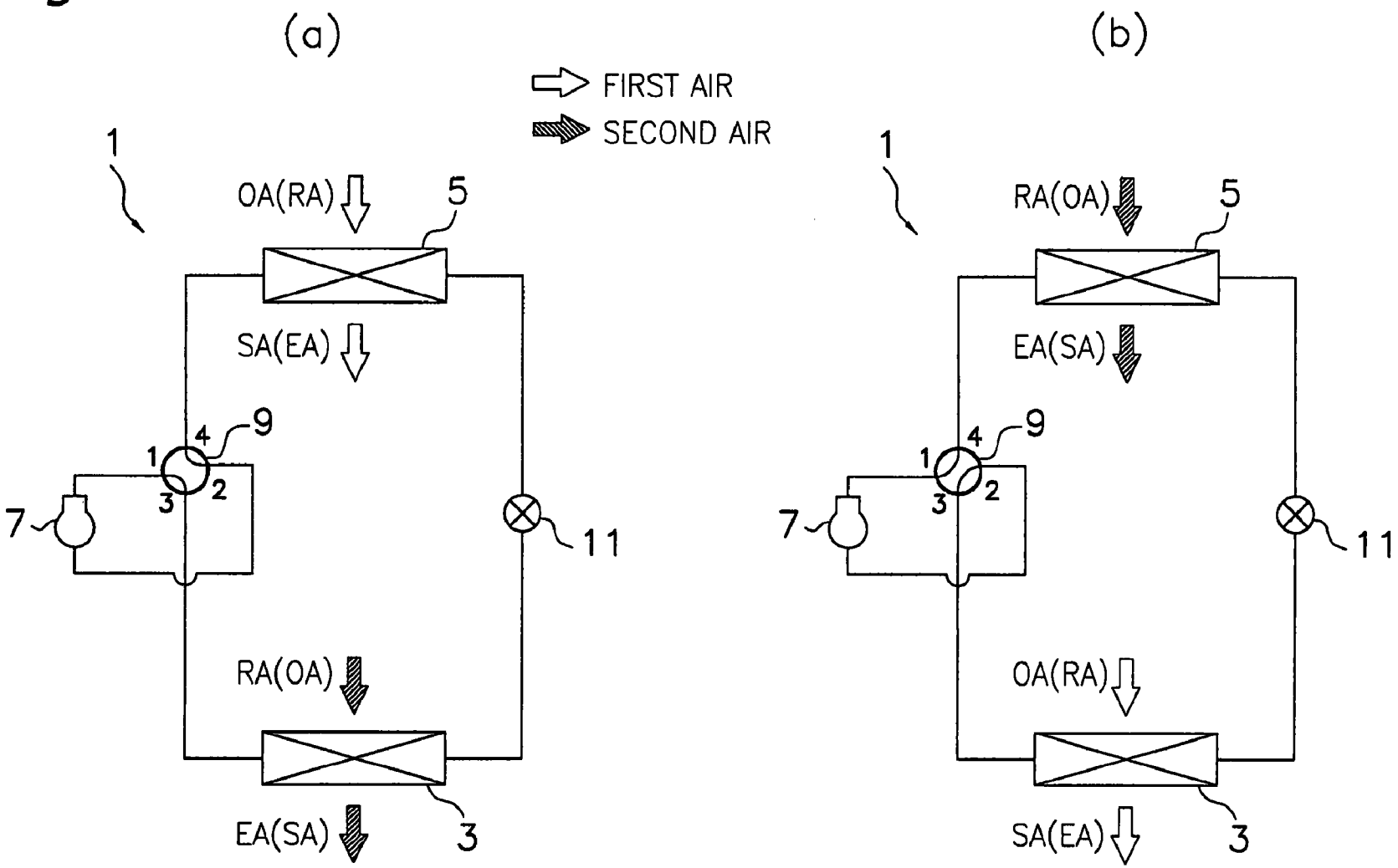
FIGS. 6(*a*) and (*b*) are circuit diagrams that depict the control state of the refrigerant circuit that constitutes the air conditioner in FIG. 1.
Figure 7:
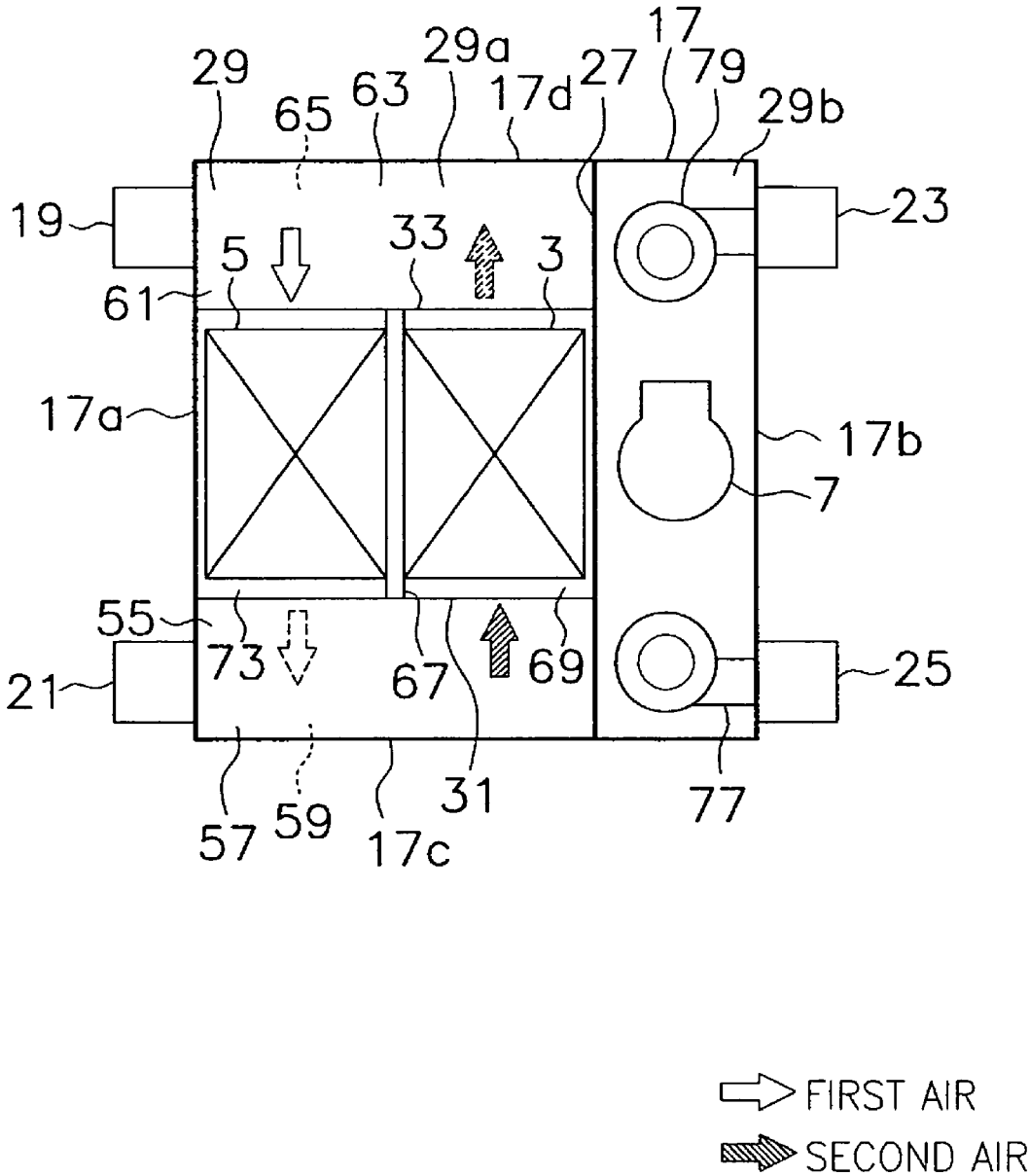
FIG. 7 is a plan view that shows the flow of air in the air conditioner in FIG. 1.
Figure 8:
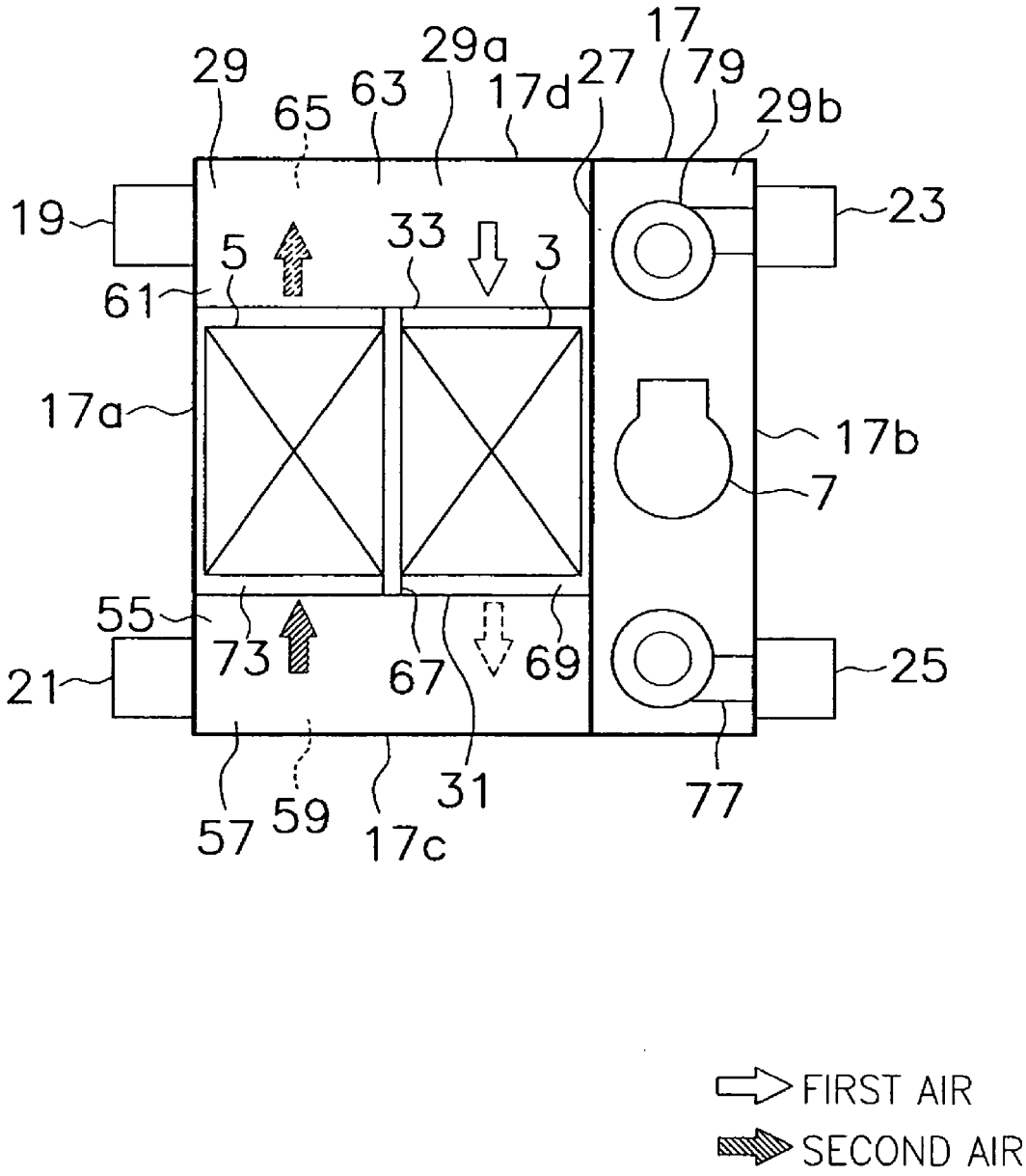
FIG. 8 is a plan view that shows the flow of air in the air conditioner in FIG. 1.
Figure 9:
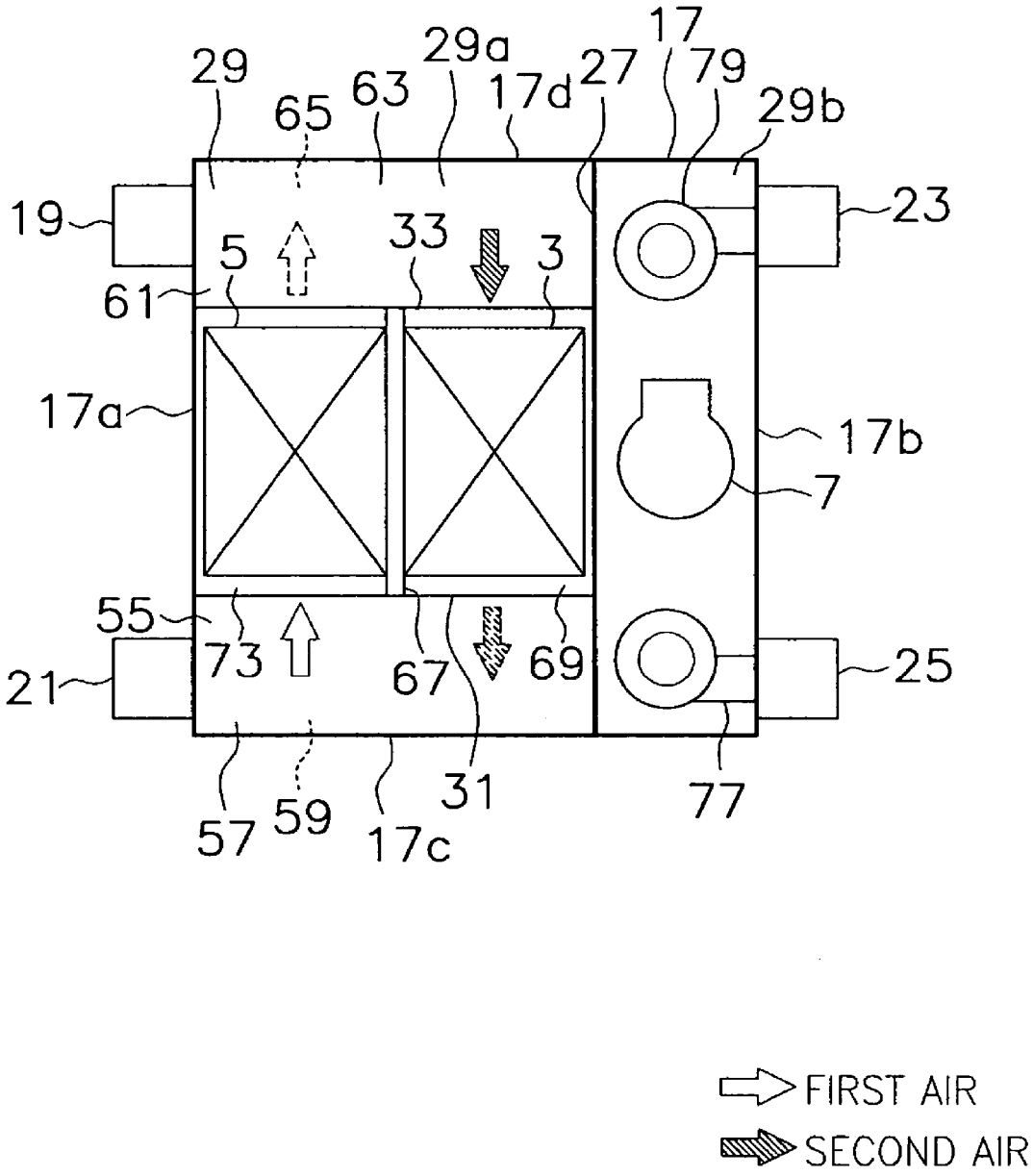
FIG. 9 is a plan view that shows the flow of air in the air conditioner in FIG. 1.
Figure 10:
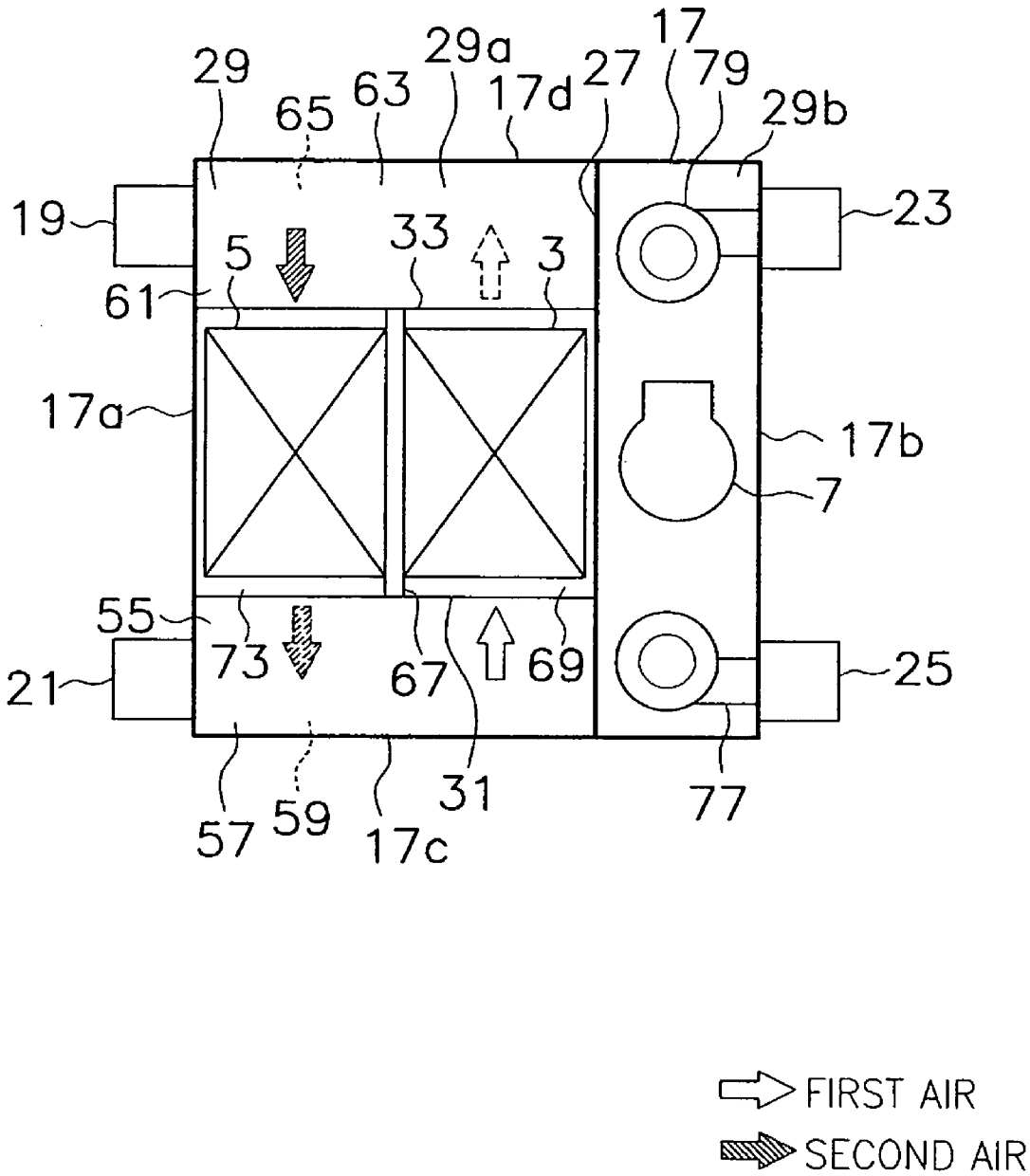
FIG. 10 is a plan view that shows the flow of air in the air conditioner in FIG. 1.

The four-way switching valve 9 is a refrigerant passageway switching means and is capable of switching: to a state wherein a first port and a third port are in communication, and, simultaneously, a second port and a fourth port are in communication, as shown in FIG. 6(*a*); and to a state wherein the first port and the fourth port are in communication, and, simultaneously, the second port and the third port are in communication, as shown in FIG. 6(*b*). Furthermore, the switching of the four-way switching valve 9 modifies the passageway of the refrigerant in the refrigerant circuit 1, and the four-way switching valve 9 is capable of switching to: a first state, wherein the first heat exchanger 3 functions as a condenser and, simultaneously, the second heat exchanger 5 functions as an evaporator; and a second state, wherein the first heat exchanger 3 functions as an evaporator and, simultaneously, the second heat exchanger 5 functions as a condenser.

(Operation)

The following explains the operation of the air conditioner 10 discussed above. The air conditioner 10 takes in a first air and a second air, and alternates between dehumidifying operation and humidifying operation. In addition, the air conditioner 10 continuously performs dehumidifying operation and humidifying operation by alternating between the first state and the second state. In addition, the air conditioner 10 performs dehumidifying operation and humidifying operation in full ventilation mode as well as in circulation mode. Below is a detailed explanation of how control is performed in each operation mode.

—Cooling and Humidifying Operation in Full Ventilation Mode—

When the air conditioner 10 performs cooling and dehumidifying operation in full ventilation mode, the control unit 80 controls each of the units of the air conditioner so that the first air, which was taken in as the outdoor air OA, is supplied to the indoor space as the air-conditioned air SA, and so that the second air that was taken in as the indoor air RA is exhausted to the outdoor space as the exhaust air EA.

<First Operation>

With a first operation, wherein the first fan 79 and the second fan 77 are driven, adsorption operation is performed in the second heat exchanger 5 and the regeneration (desorbing) operation is performed in the first heat exchanger 3. In other words, with first operation, the moisture in the outdoor air OA that was taken into the second heat exchanger 5 as the first air is adsorbed, and the moisture that was desorbed from the adsorbent, which is supported on the surface of the first heat exchanger 3, is imparted to the second air, as shown in FIG. 6(*a*) and FIG. 7.

In addition, the four-way switching valve 9 switches to a state wherein the first port and the third port are connected, and the second port and the fourth port are connected, as shown in FIG. 6(*a*). As a result, in the refrigerant circuit 1, the first heat exchanger 3 functions as a condenser and the second heat exchanger 5 functions as an evaporator.

In other words, the high temperature, high pressure refrigerant, which was discharged from the compressor 7, flows to the first heat exchanger 3 as a thermal medium for heating. In the first heat exchanger 3, the refrigerant heats the adsorbent, which is supported on the external surface of each of the fins 13 and the heat transfer tube 15; thus, the moisture from the adsorbent is desorbed and the adsorbent is thereby regenerated.

Meanwhile, the refrigerant that condensed in the first heat exchanger 3 is decompressed by the expansion valve 11. After the refrigerant has been decompressed, it flows to the second heat exchanger 5 where it serves as the thermal medium for cooling. In the second heat exchanger 5, heat of adsorption is generated when the adsorbent, which is supported on the external surface of each of the fins 13 and the heat transfer tube 15, adsorbs the moisture. The refrigerant of the second heat exchanger 5 absorbs this heat of adsorption and evaporates. The evaporated refrigerant returns to the compressor 7; thus, the refrigerant cycles through the refrigerant circuit.

In addition, by driving the first fan 79 and the second fan 77, the indoor air RA, which flowed in from the second suction port 21 as the second air, flows through the second inflow passageway 57 and the fifth opening 31*a* into the first heat exchange chamber 69. In the first heat exchange chamber 69, the second air is humidified by the releasing of the moisture desorbed from the adsorbent of the first heat exchanger 3. This humidified second air flows from the first heat exchange chamber 69 through the first outflow passageway 65 via the third opening 33*c*, and is then exhausted from the first blow out port 23 via the first fan 79 to the outdoor space as the exhaust air EA.

Meanwhile, the outdoor air OA that flowed in from the first suction port 19 flows through the first inflow passageway 63 as the first air and the second opening 33*b* into the second heat exchange chamber 73. In the second heat exchange chamber 73, the first air is dehumidified by adsorbing the moisture onto the adsorbent of the second heat exchanger 5. Furthermore, the sensible heat of the first air is robbed by the heat of evaporation of the refrigerant in the second heat exchanger 5. Thus, the cooled and dehumidified first air flows from the second heat exchange chamber 73 through the eighth opening 31*d* and the second outflow passageway 59, and is then supplied through the second blow out port 25 to the indoor space as the air-conditioned air SA via the second fan 77.

The first operation is performed until the prescribed batch switching time has elapsed, and then the second operation is performed.

<Second Operation>

With the second operation, wherein the first fan 79 and the second fan 77 are driven, adsorption operation is performed at the first heat exchanger 3, and regeneration operation is performed at the second heat exchanger 5, as shown in FIG. 6(*b*). In other words, with the second operation, the moisture in the outdoor air OA that was taken into the first heat exchanger 3 as the first air is adsorbed, and the moisture that was desorbed from the adsorbent, which is supported on the surface of the second heat exchanger 5, is imparted to the second air, which is then exhausted to the outdoor space as the exhaust air EA, as shown in FIG. 6(*b*) and FIG. 8.

In addition, the four-way switching valve 9 switches to a state wherein the first port and the fourth port are connected, and the second port and the third port are connected, as shown in FIG. 6(*b*). As a result, with the refrigerant circuit 1, the second heat exchanger 5 functions as a condenser, and the first heat exchanger 3 functions as an evaporator.

In other words, the high temperature, high pressure refrigerant, which was discharged from the compressor 7, flows to the second heat exchanger 5 as the thermal medium for heating. In the second heat exchanger 5, the refrigerant heats the adsorbent, which is supported on the external surface of each of the fins 13 and the heat transfer tube 15; thus, the moisture from the adsorbent is desorbed and the adsorbent is thereby regenerated.

Meanwhile, the refrigerant that was condensed by the second heat exchanger 5 is decompressed by the expansion valve 11. After the refrigerant has been decompressed, it flows to the first heat exchanger 3 where it serves as the thermal medium for cooling. In the first heat exchanger 3, heat of adsorption is generated when the adsorbent, which is supported on the external surface of each of the fins 13 and the heat transfer tube 15, adsorbs the moisture. The refrigerant of the first heat exchanger 3 absorbs this heat of adsorption and evaporates. The evaporated refrigerant returns to the compressor 7; thus, the refrigerant cycles through the refrigerant circuit.

In addition, by driving the first fan 79 and the second fan 77, the second air that flowed in from the second suction port 21 as the indoor air RA flows through the second inflow passageway 57 and the sixth opening 31*b* into the second heat exchange chamber 73. In the second heat exchange chamber 73, the second air is humidified by the releasing of the moisture that was desorbed from the adsorbent of the second heat exchanger 5. The humidified second air flows from the second heat exchange chamber 73 through the fourth opening 33*d* and the first outflow passageway 65, and is then exhausted as the exhaust air EA through the first blow out port 23 to the outdoor space via the first fan 79.

Meanwhile, the first air that flowed in from the first suction port 19 as the outdoor air OA flows through the first inflow passageway 63 and the first opening 33*a* into the first heat exchange chamber 69. In the first heat exchange chamber 69, the first air is dehumidified by the adsorption of the moisture onto the adsorbent of the first heat exchanger 3. Furthermore, the sensible heat of the first air is robbed by the heat of evaporation of the refrigerant in the first heat exchanger 3. Thus, the cooled and dehumidified first air flows from the first heat exchange chamber 69 through the seventh opening 31*c* and the second outflow passageway 59, and is then supplied from the second blow out port 25 to the indoor space as the air-conditioned air SA via the second fan 77.

The second operation is performed until the prescribed batch switching time has elapsed, and then the first operation is performed once again. Furthermore, the indoor space is continuously dehumidified by alternating between the first operation and the second operation every time the prescribed batch switching time elapses.

—Heating and Humidifying Operation in Full Ventilation Mode—

When the air conditioner 10 performs heating and humidifying operation in full ventilation mode, the control unit 80 controls each of the units of the air conditioner so that the first air, which was taken in as the indoor air RA, is exhausted to the outdoor space as the exhaust air EA, and so that the second air that was taken in as the outdoor air OA is supplied to the indoor space as the air-conditioned air SA.

<First Operation>

With a first operation, wherein the first fan 79 and the second fan 77 are driven, adsorption operation is performed in the second heat exchanger 5, and regeneration operation is performed in the first heat exchanger 3. In other words, with the first operation, the moisture in the indoor air RA that was taken into the second heat exchanger 5 as the first air is adsorbed, and the moisture that was desorbed from the adsorbent, which is supported on the surface of the first heat exchanger 3, is imparted to the second air, which was taken in as the outdoor air OA, as shown in FIG. 6(*a*) and FIG. 9.

In addition, the four-way switching valve 9 switches to a state wherein the first port and the third port are connected, and the second port and the fourth port are connected, as shown in FIG. 6(*a*). As a result, in the refrigerant circuit 1, the first heat exchanger 3 functions as a condenser and the second heat exchanger 5 functions as an evaporator.

In other words, the high temperature, high pressure refrigerant, which was discharged from the compressor 7, flows to the first heat exchanger 3 as a thermal medium for heating. In the first heat exchanger 3, the refrigerant heats the adsorbent, which is supported on the external surface of each of the fins 13 and the heat transfer tube 15; thus, the moisture from the adsorbent is desorbed and the adsorbent is thereby regenerated.

Meanwhile, the refrigerant that condensed in the first heat exchanger 3 is decompressed by the expansion valve 11. After the refrigerant has been decompressed, it flows to the second heat exchanger 5 where it serves as the thermal medium for cooling. In the second heat exchanger 5, heat of adsorption is generated when the adsorbent, which is supported on the external surface of each of the fins 13 and the heat transfer tube 15, adsorbs the moisture. The refrigerant of the second heat exchanger 5 absorbs this heat of adsorption and evaporates. The evaporated refrigerant returns to the compressor 7; thus, the refrigerant cycles through the refrigerant circuit.

In addition, by driving the first fan 79 and the second fan 77, the first air that flowed in from the second suction port 21 as the indoor air RA flows through the second inflow passageway 57 and the sixth opening 31*b* into the second heat exchange chamber 73. In the second heat exchange chamber 73, the first air is dehumidified by the adsorption of the moisture contained in the first air onto the adsorbent of the second heat exchanger 5. This dehumidified first air becomes the exhaust air EA and flows from the second heat exchanger 73 through the first outflow passageway 65 via the fourth opening 33*d*, and is then exhausted from the first blow out port 23 to the outdoor space via the first fan 79.

Meanwhile, the second air that flowed in from the first suction port 19 as the outdoor air OA flows through the first inflow passageway 63 and the first opening 33*a* into the first heat exchange chamber 69. In the first heat exchange chamber 69, the second air is humidified by releasing the moisture that was desorbed from the adsorbent of the first heat exchanger 3. Furthermore, the sensible heat of the refrigerant is imparted to the second air by the heat of condensation of the refrigerant in the first heat exchanger 3. Thus, the heated and humidified second air flows from the first heat exchange chamber 69 through the seventh opening 31*c* and the second outflow passageway 59, and is then supplied through the second blow out port 25 to the indoor space as the air-conditioned air SA via the second fan 77.

The first operation is performed until the prescribed batch switching time has elapsed, and then the second operation is performed.

<Second Operation>

With the second operation, wherein the first fan 79 and the second fan 77 are driven, adsorption operation is performed at the first heat exchanger 3, and regeneration operation is performed at the second heat exchanger 5. In other words, with the second operation, the moisture in the first air that was taken into the first heat exchanger 3 as the indoor air RA is adsorbed, and the moisture that was desorbed from the second heat exchanger 5 is imparted to the second air that was taken in as the outdoor air OA, as shown in FIG. 6(*b*) and FIG. 10.

In addition, the four-way switching valve 9 switches to a state wherein the first port and the fourth port are connected, and the second port and the third port are connected, as shown in FIG. 6(*b*). As a result, with the refrigerant circuit 1, the second heat exchanger 5 functions as a condenser, and the first heat exchanger 3 functions as an evaporator.

In other words, the high temperature, high pressure refrigerant, which was discharged from the compressor 7, flows to the second heat exchanger 5 as the thermal medium for heating. In the second heat exchanger 5, the refrigerant heats the adsorbent, which is supported on the external surface of each of the fins 13 and the heat transfer tube 15; thus, the moisture from the adsorbent is desorbed and the adsorbent is thereby regenerated.

Meanwhile, the refrigerant that was condensed by the second heat exchanger 5 is decompressed by the expansion valve 11. After the refrigerant has been decompressed, it flows to the first heat exchanger 3 where it serves as the thermal medium for cooling. In the first heat exchanger 3, heat of adsorption is generated when the adsorbent, which is supported on the external surface of each of the fins 13 and the heat transfer tube 15, adsorbs the moisture. The refrigerant of the first heat exchanger 3 absorbs this heat of adsorption and evaporates. The evaporated refrigerant returns to the compressor 7; thus, the refrigerant cycles through the refrigerant circuit.

In addition, by driving the first fan 79 and the second fan 77, the first air that flowed in from the second suction port 21 as the indoor air RA flows through the second inflow passageway 57 and the fifth opening 31*a* into the first heat exchange chamber 69. In the first heat exchange chamber 69, the first air is dehumidified by the adsorption of the moisture contained in the first air onto the adsorbent of the first heat exchanger 3. Furthermore, the first air is robbed of its sensible heat by the heat of evaporation of the refrigerant in the first heat exchanger 3. Thus, the cooled and dehumidified first air flows from the first heat exchange chamber 69 through the third opening 33*c* and the first outflow passageway 65, and is then exhausted from the first blow out port 23 to the outdoor space as the exhaust air EA via the first fan 79.

Meanwhile, the second air that flowed in from the first suction port 19 as the outdoor air OA flows through the first inflow passageway 63 and the second opening 33*b* into the second heat exchange chamber 73. In the second heat exchange chamber 73, the second air is humidified by the release of the moisture that was desorbed from the adsorbent of the second heat exchanger 5. The humidified air flows from the second heat exchange chamber 73 through the eighth opening 31*d* and the second outflow passageway 59, and is then supplied from the second blow out port 25 to the indoor space as the air-conditioned air SA via the second fan 77.

The second operation is performed until the prescribed batch switching time has elapsed, and then the first operation is performed once again. Furthermore, the indoor space is continuously humidified by alternating between the first operation and the second operation every time the prescribed batch switching time elapses.

—Cooling and Dehumidifying Operation in Circulation Mode—

When the air conditioner 10 performs cooling and dehumidifying operation in circulation mode, the control unit 80 controls each of the units of the air conditioner so that the indoor air RA is taken in and supplied to the indoor space as the first air, and the outdoor air OA is taken in as the second air and exhausted to the outdoor space. Furthermore, the circulation of refrigerant in the refrigerant circuit 1 is the same as in full ventilation mode, which was discussed above.

<First Operation>

With a first operation, adsorption operation is performed in the second heat exchanger 5 and regeneration (desorbing) operation is performed in the first heat exchanger 3. In other words, with the first operation, the moisture in the first air that was taken into the second heat exchanger 5 as the indoor air RA is adsorbed, and the moisture that was desorbed from the adsorbent, which is supported on the surface of the first heat exchanger 3, is imparted to the second air that was taken in as the outdoor air OA.

The second air, which flowed in from the first suction port 19 as the outdoor air OA, flows through the first inflow passageway 63 and the first opening 33*a* into the first heat exchange chamber 69. In the first heat exchange chamber 69, the second air is humidified by the releasing of the moisture desorbed from the adsorbent of the first heat exchanger 3. This humidified second air flows from the first heat exchange chamber 69 through the first outflow passageway 65 via the third opening 33*c*, and is then exhausted from the first blow out port 23 to the outdoor space as the exhaust air EA via the first fan 79.

Meanwhile, the first air that flowed in from the second suction port 21 as the indoor air RA flows through the second inflow passageway 57 and the sixth opening 31*b* into the second heat exchange chamber 73. In the second heat exchange chamber 73, the second air is dehumidified by adsorbing its moisture onto the adsorbent of the second heat exchanger 5. Furthermore, the sensible heat of the second air is robbed by the heat of evaporation of the refrigerant in the second heat exchanger 5. Thus, the cooled and dehumidified first air flows from the second heat exchange chamber 73 through the eighth opening 31*d* and the second outflow passageway 59, and is then supplied through the second blow out port 25 to the indoor space as the air-conditioned air SA via the second fan 77.

The first operation is performed until the prescribed batch switching time has elapsed, and then the second operation is performed.

<Second Operation>

With the second operation, adsorption operation is performed at the first heat exchanger 3, and regeneration operation is performed at the second heat exchanger 5. In other words, with the second operation, the moisture in the first air that was taken into the first heat exchanger 3 as the indoor air RA is adsorbed, and the moisture that was desorbed from the adsorbent, which is supported on the surface of the second heat exchanger 5, is imparted to the second air.

The second air that flowed in from the first suction port 19 as the outdoor air OA flows through the first inflow passageway 63 and the second opening 33*b* into the second heat exchange chamber 73. In the second heat exchange chamber 73, the second air is humidified by the releasing of the moisture that was desorbed from the adsorbent of the second heat exchanger 5. The humidified second air flows from the second heat exchange chamber 73 through the fourth opening 33*d* and the first outflow passageway 65, and is then exhausted as the exhaust air EA through the first blow out port 23 to the outdoor space via the first fan 79.

Meanwhile, the first air that flowed in from the second suction port 21 as the indoor air RA flows through the second inflow passageway 57 and the fifth opening 31*a* into the first heat exchange chamber 69. In the first heat exchange chamber 69, the first air is dehumidified by the adsorption of its moisture onto the adsorbent of the first heat exchanger 3. Furthermore, the sensible heat of the first air is robbed by the heat of evaporation of the refrigerant in the second heat exchanger 5. Thus, the cooled and dehumidified first air flows from the first heat exchange chamber 69 through the seventh opening 31*c* and the second outflow passageway 59, and is then supplied from the second blow out port 25 to the indoor space as the air-conditioned air SA via the second fan 77.

The second operation is performed until the prescribed batch switching time has elapsed, and then the first operation is performed once again. Furthermore, the indoor space is continuously dehumidified by alternating the first operation and the second operation every time the prescribed batch switching time elapses.

—Heating and Humidifying Operation in Circulation Mode—

When the air conditioner 10 performs heating and humidifying operation in circulation mode, the control unit 80 controls each of the units of the air conditioner so that the first air that was taken in as the outdoor air OA is exhausted to the outdoor space, and the second air that was taken in as the indoor air RA is supplied to the indoor space. Furthermore, the circulation of the refrigerant in the refrigerant circuit 1 is the same as in full ventilation mode, which was discussed above.

<First Operation>

With a first operation, adsorption operation is performed in the second heat exchanger 5, and regeneration operation is performed in the first heat exchanger 3. In other words, with the first operation, the moisture in the first air that was taken into the second heat exchanger 5 as the outdoor air OA is adsorbed, and the moisture that was desorbed from the adsorbent, which is supported on the surface of the first heat exchanger 3, is imparted to the second air that was taken in as the indoor air RA.

The second air, which flowed in from the second suction port 21 as the indoor air RA, flows through the second inflow passageway 57 and the fifth opening 31*a* into the first heat exchange chamber 69. In the first heat exchange chamber 69, the second air is humidified by the releasing of the moisture desorbed from the adsorbent of the first heat exchanger 3. Furthermore, the sensible heat of the refrigerant is imparted to the second air by the heat of condensation of the refrigerant in the first heat exchanger 3. Thus, the heated and humidified second air flows from the first heat exchange chamber 69 through the second outflow passageway 59 via the seventh opening 31*c*, and is then supplied from the second blow out port 25 to the indoor space via the second fan 77.

Meanwhile, the first air that flowed in from the first suction port 19 as the outdoor air OA flows through the first inflow passageway 63 and the second opening 33*b* into the second heat exchange chamber 73. In the second heat exchange chamber 73, the first air is dehumidified by adsorbing its moisture onto the adsorbent of the second heat exchanger 5.

The dehumidified first air flows from the second heat exchange chamber 73 through the fourth opening 33*d* and the first outflow passageway 65, and is then exhausted through the first blow out port 23 to the outdoor space as the exhaust air EA via the first fan 79.

The first operation is performed until the prescribed batch switching time has elapsed, and then the second operation is performed.

<Second Operation>

With the second operation, adsorption operation is performed at the first heat exchanger 3, and regeneration operation is performed at the second heat exchanger 5. In other words, with the second operation, the moisture in the first air that was taken into the first heat exchanger 3 as the outdoor air OA is adsorbed, and the moisture that was desorbed from the adsorbent, which is supported on the surface of the second heat exchanger 5, is imparted to the second air that was taken in as the indoor air RA.

The second air that flowed in from the second suction port 21 as the indoor air RA flows through the second inflow passageway 57 and the sixth opening 31*b* into the second heat exchange chamber 73. In the second heat exchange chamber 73, the second air is humidified by the releasing of the moisture that was desorbed from the adsorbent of the second heat exchanger 5. Furthermore, the sensible heat of the refrigerant is imparted to the second air by the heat of condensation of the refrigerant in the second heat exchanger 5. Thus, the heated and humidified second air flows from the second heat exchange chamber 73 through the eighth opening 31*d* and the second outflow passageway 59, and is then supplied through the second blow out port 25 to the indoor space as the air-conditioned air SA via the second fan 77.

Meanwhile, the first air that flowed in from the first suction port 19 as the outdoor air OA flows through the first inflow passageway 63 and the first opening 33*a* into the first heat exchange chamber 69. In the first heat exchange chamber 69, the first air is dehumidified by the adsorption of its moisture onto the adsorbent of the first heat exchanger 3. This dehumidified first air flows from the first heat exchange chamber 69 through the third opening 33*c* and the first outflow passageway 65, and is then exhausted from the first blow out port 23 to the outdoor space as the exhaust air EA via the first fan 79.

The second operation is performed until the prescribed batch switching time has elapsed, and then the first operation is performed once again. Furthermore, the indoor space is continuously humidified by alternating the first operation and the second operation every time the prescribed batch switching time elapses.

<Priority Control Operation at Startup>

Figure 12:
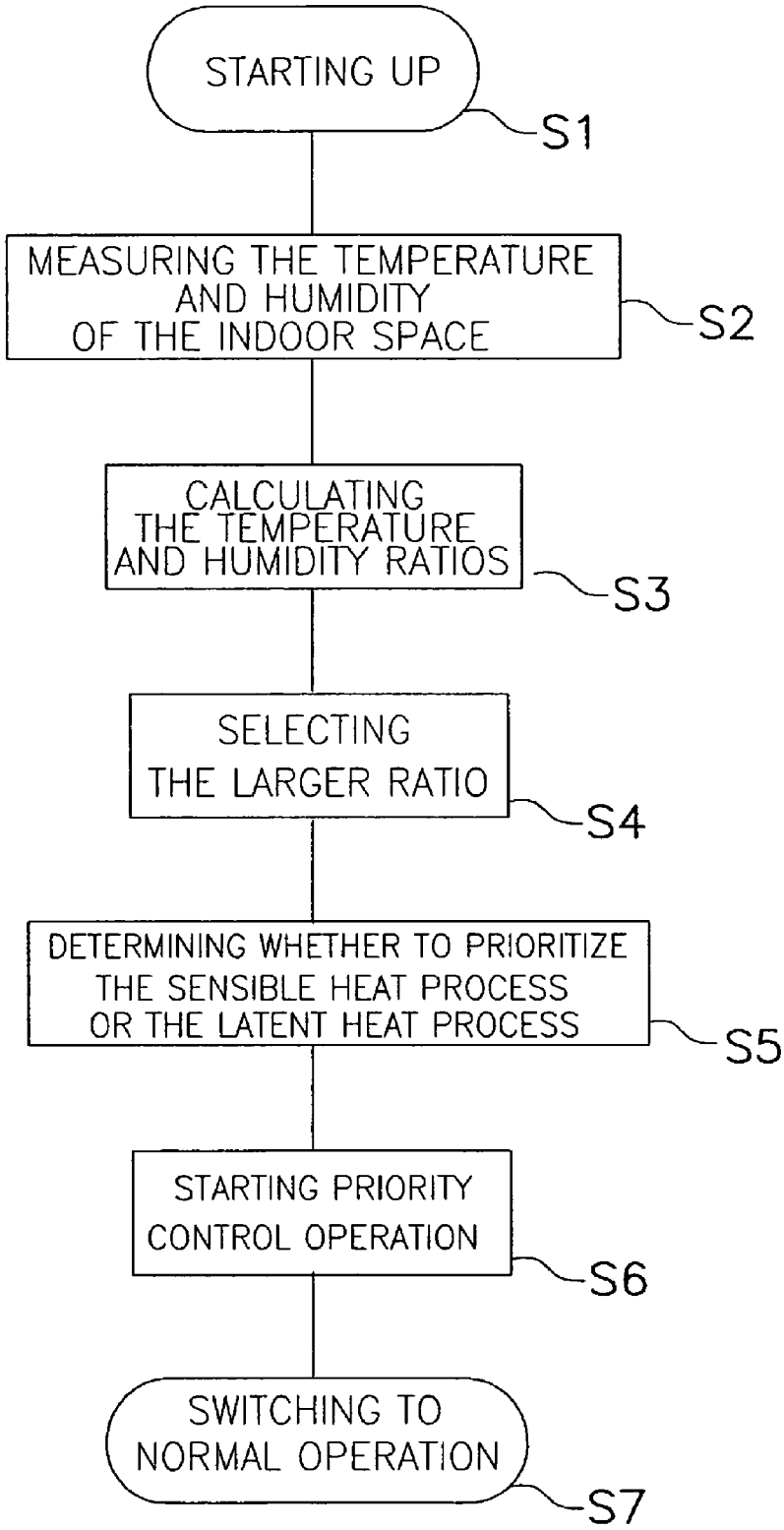
FIG. 12 is a flow chart that depicts one example of priority control operation in the air conditioner in FIG. 1.
Figure 13:
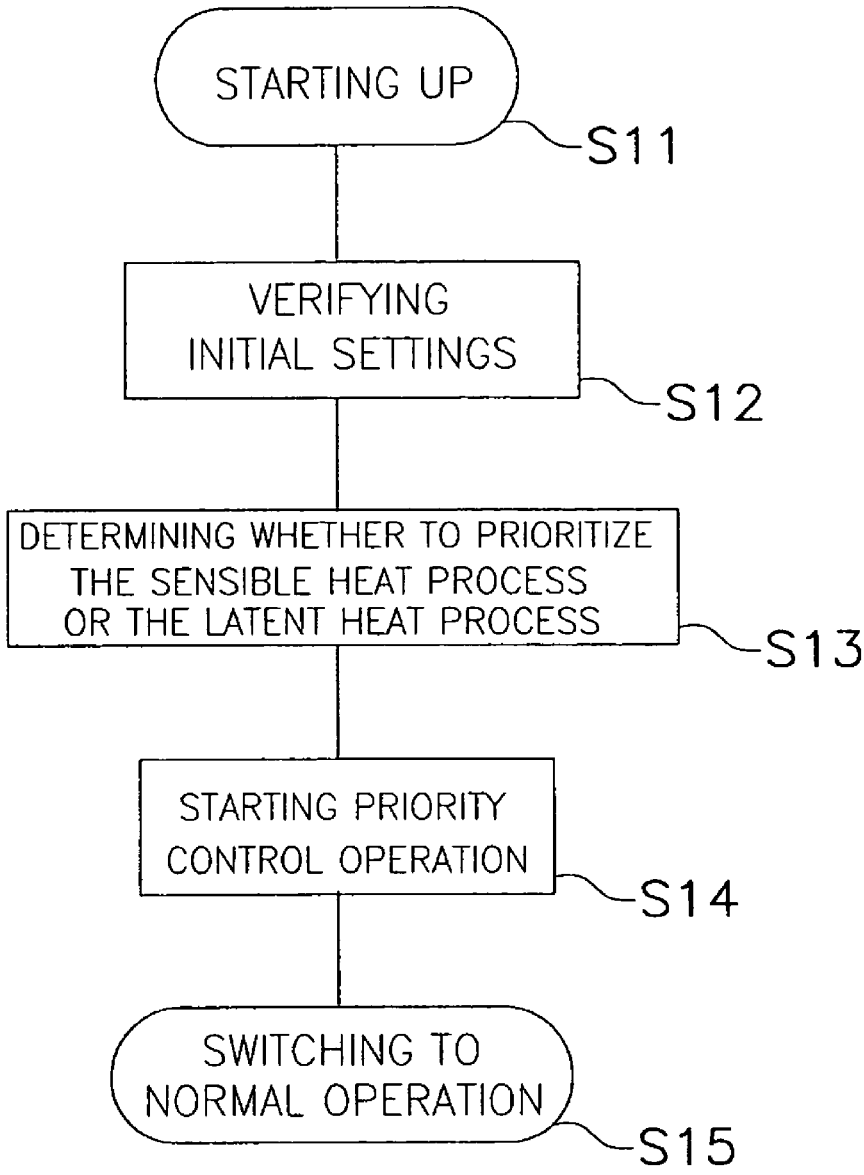
FIG. 13 is a flow chart that depicts another example of priority control operation in the air conditioner in FIG. 1.

The air conditioner 10 of the present embodiment is constituted as described above, wherein the control unit 80 performs control at startup according to the flow charts shown in FIG. 12 and FIG. 13.

—Priority Control in Accordance with the State of the Indoor Space—

First, in Step (hereinbelow, referred to as S) 1, the air conditioner 10 starts up, as shown in FIG. 12. Subsequently, in S2, the humidity sensors 3*b*, 5*b* and the temperature sensor 4 measure the humidity and the temperature of the indoor space at startup.

Here, the user sets a desired target temperature value and a target humidity value in the storage unit 81, which is internally provided to the air conditioner 10.

Consequently, in S3, the control unit 80 calculates the ratio of the measured value to the user preset value for both the temperature and the humidity. As a result, in S4, the control unit 80 selects the larger of the ratio of the measured value to the user preset value for both the temperature and the humidity, and, in S5, determines whether to prioritize the sensible heat process or the latent heat process. Furthermore, in S6, the air conditioner 10 performs a priority control operation in order to prioritize the appropriate process—the sensible heat process or the latent heat process—in accordance with the temperature and the humidity in the indoor space at startup. Furthermore, the control unit 80 performs priority control operation continuously until a prescribed condition, which is described later, is satisfied in a later stage, and then, in S7, switches to normal operation if the prescribed condition is satisfied.

The following explains the specific details of the control of priority control operation.

For example, if the control unit 80 calculates that the ratio of the actual measured value of the temperature to the preset target temperature value is larger than that of the humidity, and further makes a determination to perform sensible heat priority control operation, which prioritizes the sensible heat process, then the batch switching time, which determines when the first heat exchanger 3 and the second heat exchanger 5 alternate between adsorption operation and regeneration operation, is set so that it is longer than during normal operation. Thereby, it is possible to exchange heat between the air and the refrigerant in a state wherein the heat exchanger on the side that functions as an evaporator is sufficiently cooled; furthermore, the sensible heat is prioritized over the latent heat process because the adsorption capacity of the adsorbent, which is supported on the surface of the heat exchanger, decreases the longer the heat exchanger functions as an evaporator.

Furthermore, if a determination is made to perform priority control operation that prioritizes the sensible heat process, then control may be performed outside of the control described above by setting the condensing temperature target value of the refrigerant so that it is higher than during normal operation. Thereby, it is possible to perform the operation that increases the performance of the sensible heat process, thereby processing a greater amount of sensible heat.

Furthermore, if the air conditioner 10 of the present embodiment is a desiccant-type humidity conditioner that does not possess a ventilation function, or if it is a desiccant-type outdoor air conditioner and performs circulating operation discussed above, then control may be performed wherein the circulation of the air taken in from the outdoor space is increased. Thus, by increasing the circulation of the air, it is possible to increase the performance of the sensible heat process and to perform priority control operation that prioritizes the sensible heat process.

Meanwhile, if the control unit 80 makes a determination to perform priority control operation that prioritizes the latent heat process, then it reduces the batch switching time, which determines when the first heat exchanger 3 and the second heat exchanger 5 alternate between adsorption operation and regeneration operation, so that it is shorter than during normal operation. Thereby, it is possible to maintain a state wherein the adsorbent, which is supported on the surface of the heat exchanger on the side that functions as the evaporator, continuously has a high adsorption capacity, and it is also possible to prioritize the latent heat process over the sensible heat process because, if the batch switching time is reduced, then the heat exchanger is switched before it becomes sufficiently cooled (or heated).

Furthermore, if a determination is made to perform priority control operation that prioritizes the latent heat process, then control outside of that described above may be performed so that the condensing temperature target value of the refrigerant is set so that it is higher than during normal operation. Thereby, it is possible to increase the performance of the latent heat process and to perform operation that processes a greater amount of sensible heat.

Next, the switching of operation from priority control operation to normal operation is performed by satisfying the conditions described below.

Namely, the control unit 80 is connected to the timer 82, which is capable of setting the time at which priority control operation is performed, as shown in FIG. 11. Consequently, the control unit 80 assumes that the prescribed condition has been satisfied if the prescribed time set in the timer 82 has elapsed since the start of priority control operation, and switches from priority control operation to normal operation.

The switching from priority control operation to normal operation is not limited to switching based on the elapse of the time set in the timer 82. The control unit 80 can switch operation from priority control operation to normal operation based on the assumption that the prescribed condition has been satisfied if it recognizes, from the measurement results in the humidity sensors 3*b*, 5*b* and the temperature sensor 4, that the temperature and humidity in the indoor space have reached the temperature and humidity set values stored in the storage unit 81. In addition, the control unit 80 can also switch operation from priority control operation to normal operation based on the assumption that that the prescribed condition has been satisfied if the manual input unit 83 receives an input from the user. Furthermore, various types of control are possible by combining these switching conditions.

Furthermore, with the air conditioner 10 of the present embodiment, it is also possible to switch the prioritized process of priority control operation. Specifically, the control unit 80 may switch to priority control operation that prioritizes the latent heat process based on the measurement results in the humidity sensors 3*b*, 5*b* and the temperature sensor 4 during priority control operation, e.g., if it is determined that the latent heat load has increased (the humidity has increased) when performing priority control operation that prioritizes the sensible heat process. The same applies to switching from priority control operation that prioritizes the latent heat process to priority control operation that prioritizes the sensible heat process.

—Priority Control Based on Initial Settings—

In addition, the following explains how control is performed to determine priority control operation based on the initial settings, referencing FIG. 13.

First, in S11, the air conditioner 10 starts up, as shown in FIG. 13. Subsequently, in S12, the control unit 80 verifies the contents of the initial settings stored in the storage unit 81. Here, the contents of the initial settings are set so as to, for example, prioritize the latent heat process in the rainy season when the humidity is high, or to prioritize the sensible heat process during the summer when the temperature is high.

In S13, the control unit 80 determines whether to prioritize the sensible heat process or to the latent heat process based on the contents stored in the storage unit 81 as the initial settings. Furthermore, in S14, the air conditioner 10 starts priority control operation. Furthermore, the control unit 80 continues this priority control operation until the abovementioned prescribed condition is satisfied, and then, in S15, switches to normal operation if the prescribed condition is satisfied.

Furthermore, the specific details of control related to priority control operation that prioritizes the sensible heat process, and priority control operation that prioritizes the latent heat process, as well as the switching from priority control operation to normal operation, are as discussed above.

<Features of the Present Air Conditioner>

(1)

In the stage before the air conditioner 10 of the present embodiment starts normal operation after startup, the control unit 80 performs priority control operation that prioritizes either the sensible heat process or the latent heat process by adjusting, for example, the batch switching time in accordance with the measurement results of the temperature sensor 4 and the like, as shown in FIG. 12.

Thereby, it is possible, for example, to perform control so as to prioritize the sensible heat process if the air temperature in the indoor space is extremely high at startup, or to prioritize the latent heat process if the humidity is extremely high. Accordingly, by starting priority control operation after startup, it is possible to perform optimal operation in accordance with the environment of the indoor space at startup, and thereby to efficiently provide a comfortable environment.

(2)

The air conditioner 10 of the present embodiment comprises the humidity sensors 3*b*, 5*b* and the temperature sensor 4, which measure the temperature and the humidity, respectively, in the indoor space, as shown in FIG. 5 and FIG. 11.

Thereby, the control unit 80 can measure the temperature and the humidity in the indoor space at startup and use those measurement results as data in order to determine whether to prioritize the sensible heat process or the latent heat process in priority control operation.

(3)

With the air conditioner 10 of the present embodiment, the control unit 80 switches from priority control operation to normal operation if the abovementioned humidity sensors 3*b*, 5*b* and temperature sensor 4 detect that the temperature and/or the humidity have reached the prescribed set value after starting priority operation.

Thereby, it is possible to efficiently maintain the desired environment in the indoor space by switching to normal operation after performing priority operation, which prioritized processing either the sensible heat load or the latent heat load, and reaching the desired temperature or humidity.

(4)

With the air conditioner 10 of the present embodiment, the control unit 80 is connected to the timer 82, as shown in FIG. 11, and switches operation from priority control operation to normal operation based on the time set in the timer 82.

Thereby, performing priority control operation having set a time limit in the timer 82 makes it possible to smoothly switch from priority control operation to normal operation after the elapse of the desired time.

(5)

With the air conditioner 10 of the present embodiment, the control unit 80 is connected to the manual input unit 83, as shown in FIG. 11. Furthermore, if the manual input unit 83 receives an input from the user, then the control unit 80 switches from priority control operation to normal operation.

Thereby, it is possible to switch from priority control operation to normal operation according to the user's desired timing regardless the time set in the timer 82, the set temperature and humidity values, and the like.

(6)

With the air conditioner 10 of the present embodiment, if a change in the indoor environment is detected by, for example, the temperature sensor 4 during priority control operation, then the control unit 80 can switch to priority control operation that prioritizes the other process.

For example, if the temperature sensor 4 detects a rise in the air temperature (an increase in the sensible heat load) in the indoor space while priority control operation that prioritizes the latent heat process is being performed, then it is possible to switch to priority control operation that prioritizes the sensible heat process without proceeding until the latent heat process reaches the desired state.

Thereby, it is possible to perform flexible control in accordance with changes in the environment during priority control operation.

(7)

With the air conditioner 10 of the present embodiment, the control unit 80 is connected to the storage unit 81, as shown in FIG. 11, and performs the prescribed priority control operation before starting normal operation after startup in accordance with the initial settings stored in the storage unit 81.

Thereby, modifying the initial settings in accordance with changes in the environment and the like, e.g., by the season, makes it possible to immediately start priority control operation as determined by the initial settings without measuring the temperature and humidity in the indoor space with each startup and then determining the details of priority control operation.

(8)

The air conditioner 10 of the present embodiment comprises two heat exchangers (the first heat exchanger 3 and the second heat exchanger 5) and the adsorbent, which is supported on the surface of each of the heat exchangers 3, 5, as shown in FIG. 1, FIG. 5, and the like. In addition, the control unit 80 is connected to the air passageway switching mechanism 91 and the four-way switching valve 9, which switches the passageway of the refrigerant, as shown in FIG. 11. Furthermore, every time the prescribed batch switching time elapses, the control unit 80 switches the abovementioned air passageway switching mechanism 91 and the like between: a first state, wherein the first heat exchanger 3 is made to function as a condenser and the moisture is desorbed from the adsorbent, and wherein the second heat exchanger 5 is made to function as an evaporator and the moisture is adsorbed onto the adsorbent; and a second state, wherein the first heat exchanger 3 is made to function as an evaporator and the moisture is adsorbed onto the adsorbent, and wherein the second heat exchanger 5 is made to function as a condenser and the moisture is desorbed from the adsorbent (refer to FIG. 6(*a*), FIG. 6(*b*), and FIG. 7 through FIG. 10).

Thereby, it is possible to perform so-called batch control by alternating the plurality of heat exchangers between functioning as an evaporator and functioning as a condenser every time the prescribed batch switching time elapses.

(9)

If the air conditioner 10 of the present embodiment is an air conditioner that performs batch control, which was discussed above, and performs priority control operation that prioritizes the sensible heat process, then the batch switching time is set so that it is longer than during normal operation.

Thereby, it is possible to make each of the heat exchangers 3, 5 function as a condenser or an evaporator until the temperature sufficiently rises or falls by extending the batch switching time, and it is consequently possible to perform priority control operation that prioritizes the sensible heat process.

In addition, the condensation target temperature of the refrigerant that flows through the refrigerant circuit 1 shown in FIG. 5 may be set so that it is higher than during normal operation.

Thereby, the performance of the sensible heat process can be improved, and it is consequently possible to perform priority control operation that prioritizes the sensible heat process.

Furthermore, even in circulation mode, which was discussed above, it is possible to perform priority control operation that prioritizes the sensible heat process under conditions that are the same as those explained above.

(10)

If the air conditioner 10 of the present embodiment performs batch control, which was discussed above, and performs priority control operation that prioritizes the latent heat process, then the batch switching time is set so that it is shorter than during normal operation.

Thereby, it is possible to continuously maintain the adsorbent in a comparatively dry state because switching is performed before the temperature of each of the heat exchangers 3, 5 sufficiently rises or falls. Accordingly, it is possible to implement-priority control operation that prioritizes the latent heat process over the sensible heat process.

In addition, if the air conditioner 10 of the present embodiment performs batch control, which was discussed above, and performs priority control operation that prioritizes the latent heat process, then the condensation target temperature of the refrigerant that flows through the refrigerant circuit 1 shown in FIG. 5 is set so that it is higher than during normal operation.

Thereby, the performance of the latent heat process can be improved, and it is consequently possible to perform priority control operation that prioritizes the latent heat process.

Furthermore, even in circulation mode, it is possible to perform priority control operation that prioritizes the latent heat process under conditions that are the same as those explained above—the same as with priority control operation that prioritizes the sensible heat process.

(11)

With the air conditioner 10 of the present embodiment, the control unit 80 is connected to the air passageway switching mechanism 91, as shown in FIG. 11, and, in batch control operation discussed above, performs circulating operation by: processing the sensible heat load or the latent heat load with respect to the air taken in from the indoor space; circulating the processed air by exhausting it to the indoor space while supplying the sensible heat load or the latent heat load to the air taken in from the outdoor space; and then exhausting the air to the outdoor space. Furthermore, if the sensible heat process is prioritized when performing such a circulating operation, then the control unit 80 controls the operation of the air passageway switching mechanism 91 so as to increase the circulation of the air taken in from the outdoor space.

Thereby, the efficiency of the sensible heat process can be raised by increasing the air volume in the heat exchanger of the heat exchangers 3, 5 that is performing the sensible heat process, and it is consequently possible to perform priority control operation that prioritizes the sensible heat process.

Furthermore, even in the abovementioned circulating operation, it is possible to perform operation that prioritizes the sensible heat process by other methods, such as extending the batch switching time, setting a high refrigerant condensing temperature, and the like.

(12)

The method of controlling the air conditioner 10 of the present embodiment performs priority control operation at startup in accordance with the flow chart shown in FIG. 12 and FIG. 13. Namely, the temperature and humidity in the indoor space is measured at startup to determine whether to perform priority control operation that prioritizes the sensible heat process or to the latent heat process. Alternatively, priority control operation is performed at startup based on the details determined by the initial settings.

Thereby, it is possible to perform operation that prioritizes the appropriate process in accordance with the indoor space environment at startup, changes in the season, and the like, and it is consequently possible to efficiently maintain a comfortable environment in the indoor space at startup.

Other Embodiments

The above explained an embodiment of the present invention, but the specific constitution is not limited to these embodiments, and it is understood that variations and modifications may be effected without departing from the spirit and scope of the invention.

(A)

The present embodiment was explained citing an example wherein the air conditioner 10 is a desiccant-type outdoor air conditioner. However, the present invention is not limited thereto.

Figure 14:
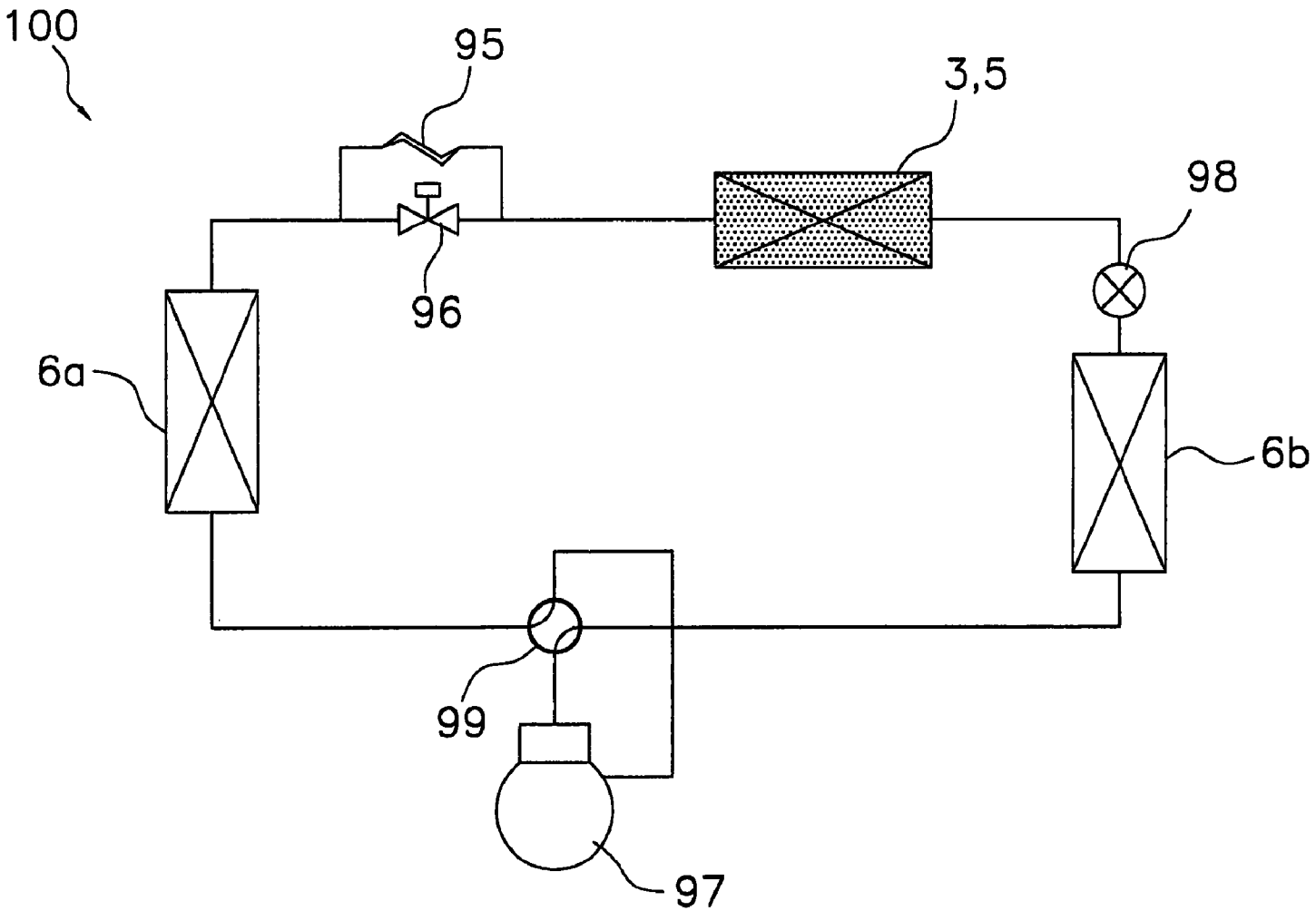
FIG. 14 is a refrigerant circuit diagram that depicts the constitution of the air conditioner according to another embodiment of the present invention.

For example, as shown in FIG. 14(*a*), the air conditioner may be one that constitutes a refrigerant circuit 100, which comprises a heat exchanger 6*a* for performing the sensible heat process. Even with such a constitution, it is possible to perform priority control operation that prioritizes the sensible heat process or the latent heat process in the first heat exchanger 3 and the second heat exchanger 5 regardless of the presence of the heat exchanger 6*a*.

The following explains an air conditioner that comprises the refrigerant circuit 100 shown in FIG. 14(*a*) and the like.

The refrigerant circuit 100 comprises one compressor 97, one expansion valve 98, and one four-way switching valve 99. In addition, the refrigerant circuit 100 is provided with an outdoor heat exchanger 6*b*, the indoor heat exchanger 6*a*, and the heat exchangers 3, 5. With the refrigerant circuit 100, the outdoor heat exchanger 6*b* constitutes a heat source side heat exchanger, and the indoor heat exchanger 6*a* and the heat exchangers 3, 5 constitute utilization side heat exchangers.

The refrigerant circuit 100 is provided with a solenoid valve 96 and a capillary tube 95. The solenoid valve 96 is provided between the indoor heat exchanger 6*a* and the heat exchangers 3, 5. One end of the capillary tube 95 is connected between the solenoid valve 96 and the heat exchangers 3, 5, and the other end is connected between the solenoid valve 96 and the indoor heat exchanger 6*a*.

With the air conditioner that comprises the refrigerant circuit 100, dehumidifying and cooling operation as well as humidifying and heating operation are performed.

For example, during dehumidifying and cooling operation, the four-way switching valve 99 is set to a first state, wherein the outdoor heat exchanger 6*b* functions as a condenser and the indoor heat exchanger 6*a* functions as an evaporator. In addition, adsorption operation, wherein each of the heat exchangers 3, 5 functions as an evaporator, and regeneration operation, wherein each of the heat exchangers 3, 5 functions as a condenser, are performed alternately. Furthermore, during dehumidifying and cooling operation, the outdoor air is supplied to the outdoor heat exchanger 6*b*, and the indoor air is supplied to the indoor heat exchanger 6*a* and the heat exchangers 3, 5. Furthermore, the air that was cooled by the indoor heat exchanger 6*a* is continuously supplied to the indoor space, while the air that was dehumidified by the heat exchangers 3, 5 is intermittently supplied to the indoor space.

During adsorption operation, the solenoid valve 96 is opened, and the degree of opening of the expansion valve 98 is appropriately regulated. In this state, the refrigerant discharged from the compressor 97 is condensed by the outdoor heat exchanger 6*b*, decompressed by the expansion valve 98, subsequently evaporated while passing through the heat exchangers 3, 5 and the indoor heat exchanger 6*a* in that order, and then enters the compressor 97 where it is compressed.

During this adsorption operation, the outdoor air that absorbed the heat from the refrigerant at the outdoor heat exchanger 6*b* is exhausted to the outdoor space, and the indoor air that was cooled by the indoor heat exchanger 6*a* is fed back to the indoor space. In addition, with the heat exchangers 3, 5, the moisture in the indoor air is adhered onto the adsorbing material, which dehumidifies the indoor air, and the heat of adsorption generated at that time is absorbed by the refrigerant. The indoor air that was dehumidified by the heat exchangers 3, 5 is fed back to the indoor space.

During regeneration operation, the solenoid valve 96 is blocked, and the expansion valve 98 is set so that it is fully open. In this state, the refrigerant that was discharged from the compressor 97 is condensed while passing through the outdoor heat exchanger 6*b* and the heat exchangers 3, 5 in that order, subsequently decompressed by the capillary tube 95, evaporated by the indoor heat exchanger 6*a*, and then enters the compressor 97 where it is compressed.

During regeneration operation, the outdoor air that absorbed heat from the refrigerant at the outdoor heat exchanger 6*b* is exhausted to the outdoor space, and the indoor air that was cooled by the indoor heat exchanger 6*a* is fed back to the indoor space. In addition, at the heat exchangers 3, 5, the refrigerant heats and regenerates the adsorbing material, and the moisture desorbed from the adsorbing material is imparted to the indoor air. The moisture desorbed from the heat exchangers 3, 5 is exhausted to the outdoor space along with the exhaust air.

Furthermore, heating and humidifying operation is substantially the same as cooling and dehumidifying operation, which was discussed above, and the explanation thereof is consequently omitted.

(B)

The abovementioned embodiments were explained citing an example wherein the air conditioner 10 comprises two heat exchangers (the first heat exchanger 3 and the second heat exchanger 5), and wherein batch control is performed. However, the present invention is not limited thereto.

For example, the air conditioner 10 may be a flow-type air conditioner (refer to Japanese Published Unexamined Patent Application No. 2001-208374) that performs adsorption operation and regeneration operation by a method, such as using a single heat exchanger and rotating a humidity conditioning unit that supports an adsorbent. Even with such a flow-type air conditioner, it is possible to perform priority control operation at startup as described in the abovementioned embodiments.

Furthermore, in contrast to the desiccant-type outdoor air conditioner of the abovementioned embodiment, which comprises a ventilation function, the air conditioner of the present invention may be a desiccant-type humidity conditioner that does not comprise a ventilation function.

(C)

The abovementioned embodiments were explained citing an example wherein the air conditioner 10 comprises two heat exchangers (the first heat exchanger 3 and the second heat exchanger 5). However, the present invention is not limited thereto.

For example, the air conditioner 10 may comprise three or more heat exchangers, and may perform batch control so that the heat exchangers are alternated between a first state, wherein a prescribed number of heat exchangers perform adsorption operation and the other heat exchangers perform regeneration operation, and a second state, wherein the abovementioned prescribed number of heat exchangers perform regeneration operation and the other heat exchangers perform adsorption operation.

(D)

The abovementioned embodiments were explained citing an example wherein the adsorbent is supported on the surfaces of the first heat exchanger 3 and the second heat exchanger 5. However, the present invention is not limited thereto.

Figure 15:
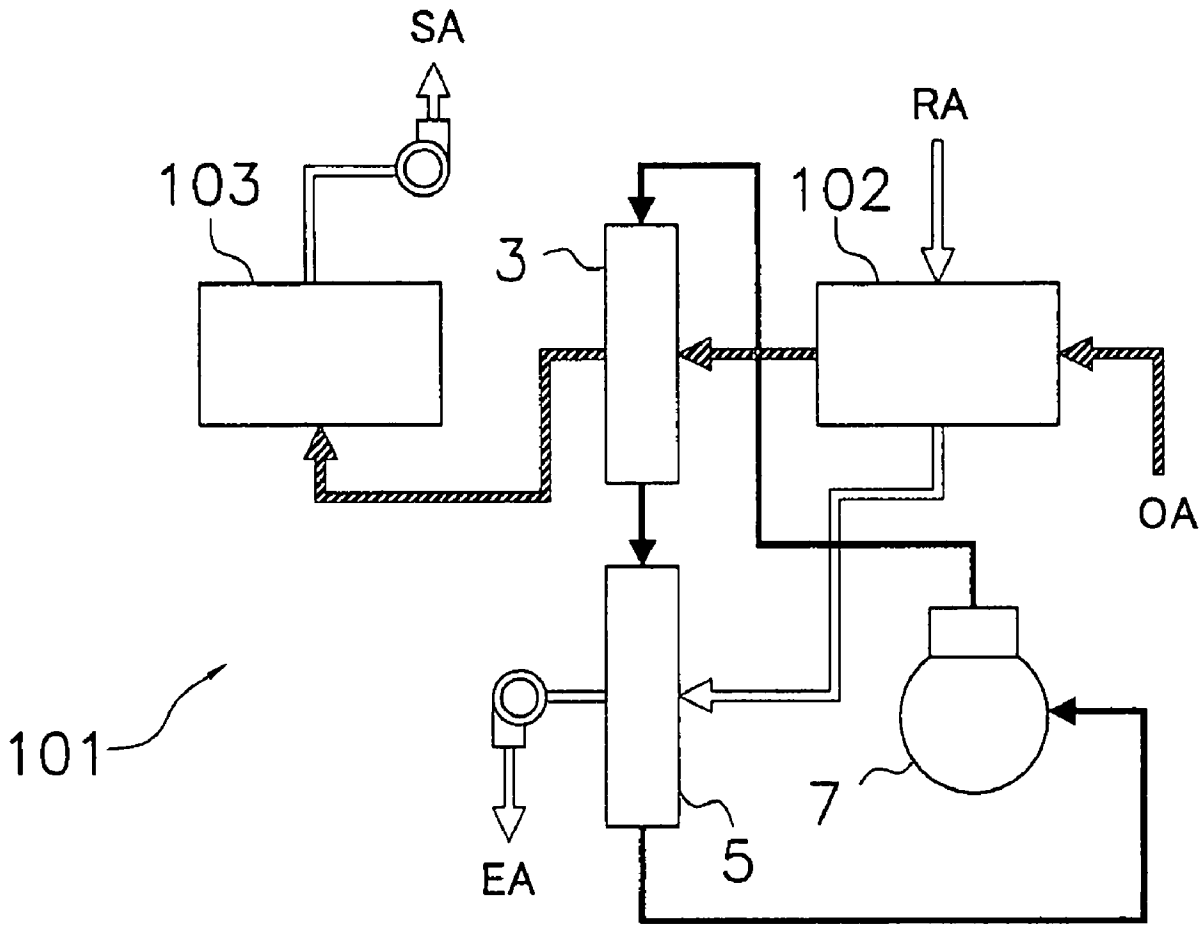
FIG. 15 is a refrigerant circuit diagram that depicts the constitution of the air conditioner according to yet another embodiment of the present invention.

For example, the air conditioner may be an air conditioner 101 wherein humidity conditioning elements 102, 103, which each comprise an adsorbent, are disposed in the vicinity of the first heat exchanger 3 and the second heat exchanger 5, as shown in FIG. 15, and the air before or after passing through the first heat exchanger 3 and the second heat exchanger 5 is caused to pass through the humidity conditioning elements 102, 103. Even with such a constitution, the air conditioner 101 can perform adsorption operation and regeneration operation with respect to the adsorbent by transmitting the heat of evaporation and the heat of condensation of each of the heat exchangers 3, 5. Furthermore, the circuit shown in FIG. 15 indicates the directions of the flows of the refrigerant and the air during humidifying operation.

(E)

The abovementioned embodiments were explained citing an example wherein the first heat exchanger 3 and the second heat exchanger 5 are cross fin-type fin and tube heat exchangers. However, the present invention is not limited thereto.

For example, the heat exchangers may be of another type, such as corrugated fin-type heat exchangers.

(F)

The abovementioned embodiments were explained citing an example wherein the adsorbent is supported on the external surfaces of each of the fins 13 and the heat transfer tube 15 by dip forming. However, the present invention is not limited thereto.

For example, the adsorbents may be supported on the external surfaces by any method as long as the adsorbent does not diminish its performance.

(G)

The abovementioned embodiments were explained citing an example wherein the air conditioner comprises a temperature sensor 4, which measures the temperature in the indoor space, and humidity sensors 3*b*, 5*b*, which measure the humidity in the indoor space. However, the present invention is not limited thereto.

For example, the air conditioner may comprise either the temperature sensor 4 or the humidity sensors 3*b*, 5*b*. However, in this case, it is not possible to determine priority control operation based on both the temperature and the humidity, and it is consequently preferable that the air conditioner comprises a temperature sensor 4 that measures the air temperature in the indoor space as well as humidity sensors 3*b*, 5*b* that measure the humidity in the indoor space, as in the abovementioned embodiments, if it is desired to perform precise control in accordance with the environment in the indoor space at startup.

Furthermore, the humidity sensors 3*b*, 5*b* are provided, but one of each may be provided.

INDUSTRIAL FIELD OF APPLICATION

The air conditioner of the present invention achieves an effect wherein it is possible to efficiently maintain a comfortable environment in an indoor space by performing priority control operation at startup, and can therefore be widely adapted to, for example, an outdoor air conditioner or a desiccant-type humidity conditioner provided with functions that process both the sensible heat load and the latent heat load.

What is claimed is:

1. An air conditioner that processes a sensible heat load and a latent heat load in an indoor space by performing a vapor compression type refrigeration cycle operation, comprising:

a control unit configured to perform a priority control operation that prioritizes processing at least one of said sensible heat load and said latent heat load from startup until a normal operation is started; and a detector unit configured to detect at least one of temperature and humidity in said indoor space, during said priority control operation, said control unit switching from said priority control operation that prioritizes processing said sensible heat load to priority control operation that prioritizes processing said latent heat load, or from said priority control operation that prioritizes processing said latent heat load to said priority control operation that prioritizes processing said sensible heat load based on a detection result from said detector unit.

2. The air conditioner as recited in claim 1, wherein said control unit switches from said priority control operation to said normal operation if said detector unit detects that at least one of the temperature and the humidity in said indoor space has reached a preset value.

3. The air conditioner as recited in claim 1, further comprising:

a timer unit in which a time limit for performing said priority control operation is set, said control unit switches from said priority control operation to said normal operation based on the time set in said timer unit.

4. The air conditioner as recited in claim 1, wherein said control unit switches from said priority control operation to said normal operation if there is a manual input from the user.

5. The air conditioner as recited in claim 1, wherein said control unit determines, based on an initial setting, whether to perform said priority control operation that prioritizes processing said sensible heat load or processing said latent heat load at startup.

6. An air conditioner that processes a sensible heat load and a latent heat load in an indoor space by performing a vapor compression type refrigeration cycle operation, comprising:

a control unit configured to perform a priority control operation that prioritizes processing at least one of said sensible heat load and said latent heat load from startup until a normal operation is started;

an adsorbent that adsorbs moisture in the air; and a heat exchanger in which refrigerant flows in a refrigerant circuit, when a batch switching time elapses, said control unit alternating said heat exchanger between a regeneration operation, in which said heat exchanger is made to function as a condenser and desorbs the moisture from said adsorbent, and an adsorption operation, in which said heat exchanger is made to function as an evaporator and adsorbs the moisture in the air onto said adsorbent.

7. The air conditioner as recited in claim 6, wherein processing said sensible heat load is prioritized in said priority control operation, and said control unit performs at least one of control that sets said batch switching time so that it is longer than during said normal operation, and control that sets a condensing temperature target value of the refrigerant in said refrigeration cycle so that it is higher than during said normal operation.

8. The air conditioner as recited in claim 6, wherein processing said latent heat load is prioritized in said priority control operation, and said control unit performs at least one of control that sets said batch switching time so that it is shorter than during said normal operation, and control that sets a condensing temperature target value of the refrigerant in said refrigeration cycle so that it is higher than during said normal operation.

9. The air conditioner as recited in claim 6, wherein a circulating operation is performed in which said sensible heat load or said latent heat load of the air taken in from said indoor space is processed, said processed air is exhausted to the indoor space, said sensible heat load or said latent heat load is supplied to the air taken in from the outdoor space and then exhausted thereto.

10. The air conditioner as recited in claim 9, wherein processing said sensible heat load is prioritized in said priority control operation, and said control unit performs at least one of control that sets said batch switching time so that it is longer than during said normal operation, control that sets a condensing temperature target value of the refrigerant in said refrigeration cycle so that it is higher than during said normal operation, and control that increases the circulation of air taken in from said outdoor space.

11. The air conditioner as recited in claim 9, wherein processing said latent heat load is prioritized in said priority control operation, and said control unit performs at least one of control that sets said batch switching time so that it is shorter than during said normal operation, and control that sets a condensing temperature target value of the refrigerant in said refrigeration cycle so that it is higher than during said normal operation.

12. The air conditioner as recited in claim 6, wherein processing said sensible heat load is prioritized in said priority control operation, and said control unit sets said batch switching time so that it is longer than during said normal operation, processing said latent heat load is prioritized in said priority control operation, and said control unit sets said batch switching time so that it is shorter than during said normal operation.

* * * * *